US009163452B2

(12) United States Patent
Zhang

(10) Patent No.: US 9,163,452 B2
(45) Date of Patent: Oct. 20, 2015

(54) MULTI-SLAT COMBINATION BLIND OF ROTATING TYPE

(75) Inventor: Yifei Zhang, Zhejiang (CN)

(73) Assignee: HANGZHOU WOKASOLAR TECHNOLOGY CO., LTD., Binjiang District, Hangzhou, Zhejiang (CN)

( * ) Notice: Subject to any disclaimer, the term of this patent is extended or adjusted under 35 U.S.C. 154(b) by 97 days.

(21) Appl. No.: 13/695,086

(22) PCT Filed: Apr. 29, 2011

(86) PCT No.: PCT/CN2011/073554

§ 371 (c)(1),
(2), (4) Date: Oct. 29, 2012

(87) PCT Pub. No.: WO2011/134431

PCT Pub. Date: Nov. 3, 2011

(65) Prior Publication Data

US 2013/0042982 A1 Feb. 21, 2013

(30) Foreign Application Priority Data

Apr. 30, 2010 (CN) ..... 2010 1 0162464

(51) Int. Cl.
*E06B 9/00* (2006.01)
*E06B 9/386* (2006.01)

(52) U.S. Cl.
CPC ..... *E06B 9/386* (2013.01)

(58) Field of Classification Search
CPC ..... E06B 9/386
USPC ..... 49/92.1; 359/596, 597, 598; 160/236, 160/114, 115, 220
See application file for complete search history.

(56) References Cited

U.S. PATENT DOCUMENTS

| | | | | | |
|---|---|---|---|---|---|
| 2,117,953 | A | * | 5/1938 | Grau | 160/114 |
| 3,292,309 | A | * | 12/1966 | Horner | 49/64 |
| 4,245,435 | A | * | 1/1981 | Ulbricht | 49/64 |
| 4,304,218 | A | * | 12/1981 | Karlsson | 126/607 |
| 4,509,825 | A | * | 4/1985 | Otto et al. | 359/592 |
| 4,593,738 | A | * | 6/1986 | Chi Yu | 160/176.1 R |
| 4,984,617 | A | * | 1/1991 | Corey | 160/84.02 |
| 5,409,050 | A | * | 4/1995 | Hong | 160/168.1 R |
| 5,423,367 | A | * | 6/1995 | Kataoka et al. | 160/168.1 R |
| 6,167,938 | B1 | * | 1/2001 | Chien | 160/168.1 R |
| 6,227,280 | B1 | * | 5/2001 | Wirth et al. | 160/166.1 |

(Continued)

FOREIGN PATENT DOCUMENTS

| | | | | | |
|---|---|---|---|---|---|
| DE | 10147523 | A1 | * | 4/2003 | E06B 9/386 |
| JP | 04353812 | A | * | 12/1992 | G02B 7/182 |
| WO | WO 2011089542 | A1 | * | 7/2011 | |

*Primary Examiner* — Katherine Mitchell
*Assistant Examiner* — Johnnie A Shablack
(74) *Attorney, Agent, or Firm* — Global IP Services; Tianhua Gu

(57) ABSTRACT

A multi-slat combination blind of rotation type, that includes a main slat (1) and rotating slat(s) (2). The main slat (1) is composed of a outside part (11) and a inside part (12). A joint section is the edge of the outside part meets the inside part at the width direction. The included angle between the outside part and the horizontal plane is $\gamma_1$, and the included angle between the inside part and the horizontal plane is $\gamma_2$. The rotating slat is hinged on the main slat, which is driven by the mechanism system. The blind of present invention can block and guide sunlight according to different seasons and personalized requirements.

14 Claims, 19 Drawing Sheets

(56) References Cited

U.S. PATENT DOCUMENTS

| | | | | |
|---|---|---|---|---|
| 6,239,910 | B1 * | 5/2001 | Digert | 359/596 |
| 6,240,999 | B1 * | 6/2001 | Koster | 160/176.1 R |
| 6,318,441 | B1 * | 11/2001 | Love et al. | 160/236 |
| 6,644,377 | B1 * | 11/2003 | Lewis | 160/176.1 R |
| 6,675,859 | B2 * | 1/2004 | Nien | 160/89 |
| 6,834,702 | B2 * | 12/2004 | Nien | 160/178.1 R |
| 6,845,805 | B1 * | 1/2005 | Koster | 160/236 |
| 7,021,359 | B2 * | 4/2006 | Yu et al. | 160/84.04 |
| 7,195,050 | B2 * | 3/2007 | Nien | 160/168.1 R |
| 8,413,705 | B2 * | 4/2013 | Castel | 160/107 |
| 8,462,437 | B2 * | 6/2013 | Thuot et al. | 359/596 |
| 8,496,043 | B2 * | 7/2013 | Buser | 160/236 |
| 8,678,067 | B2 * | 3/2014 | Berezhnyy et al. | 160/1 |
| 2011/0259529 | A1 * | 10/2011 | Clear | 160/7 |
| 2012/0085504 | A1 * | 4/2012 | Cha | 160/236 |
| 2013/0037224 | A1 * | 2/2013 | Zhang | 160/220 |
| 2013/0250422 | A1 * | 9/2013 | Tandler | 359/596 |
| 2013/0321923 | A1 * | 12/2013 | Thuot et al. | 359/596 |

* cited by examiner

MECHANISM SYSTEM

MULTI-SLAT COMBINATION BLIND OF ROTATING TYPE

CROSS REFERENCE TO RELATED PATENT APPLICATION

The present application is the U.S. national stage of PCT/CN2011/073554 filed on Apr. 29, 2011, which claims the priority of the Chinese patent application No. 201010162464.4 filed on Apr. 30, 2010, which application is incorporated herein by reference.

FIELD OF THE INVENTION

The present invention relates to a kind of blind structure for blocking or guiding light, specifically, relates to a kind of multi-slat combination blind of rotating type.

BACKGROUND OF THE INVENTION

Louver allows too much sunlight into room near window, resulting in glare near the window and indoor overheat, but insufficient bright at deep room. It is impossible to bright a big office evenly by natural light with commercial blinds available in current market. In sunshine day, sunlight is kept out to reduce the light and heat, which causes office too dark, and artificial lighting has to be used to get bright enough illumination. That results in more energy expense, people's uncomfortableness and lower work efficiency. Therefore, a new kind of sun-shading and light-guiding blind is invented. This invention can anti-glare and prevent overheating as commercial blind, also guide the sunlight into deep room, which makes the room lighted by sunlight evenly, and heated by sunlight in winter to reduce the heating costs.

Generally speaking, sun-shading and light-guide blind may be divided into upper and lower two parts (usually the boundary between upper and lower part takes human-height as benchmark, which is 1.9 m in West and 1.8 m in Asia properly), the louver rotating gradient of these two parts may be dependent or independent. Usually the lower louver may be set as anti-glare and prevention overheating, and the upper louver may be set to import the light into deep room. Besides increasing design cost, this system has a fault—the functions of two parts, anti-glare or guiding light, are defined in advance, therefore cannot be adjusted according to users, seasons and specific lighting condition of workplace.

Indoor illumination condition depends upon not only seasons, sun position, sky condition (cloudy or sunny), but also working condition, such as work types, height, work location, and distance from the window. Obviously, sun-shading and light-guiding blind defined by architects and architectural lighting engineers cannot meet all said requirements but a compromise among them. In addition, the costs of design and blind are increased seriously if different blinds were installed for different situations.

European patent (EP0400662B1) publishes a sun-shading blind, including outside and inside parts. They are linked by rotating shaft; and their activities are controlled by rope respectively. Outside part can block sunlight to outdoor by rotating to special position, and inside part can guide sunlight to deep room if necessary. Based on EP0400662B1, Germany patent (DE29814826U1) introduces artificial fiber hinged film brackets whose shapes are close to each slat's radian shape. Rope can easily control two slats' rotation around hinge. Germany patent (DE10147523A1) makes improvement on the rope control structure based on European patent (EP0400662B1), finding a better rope control structure for blind. However, these patents did not consider the combination blind's transparency, retro-reflection, deflection light guiding and optimal light adjustment according to personalize demands for sunlight.

European patent (EP1212508B1) describes a blind with differently shaped slats, with toothed or smooth surface. The curved slat with teeth and the W-shaped slat showed excellent properties respectively on retro-reflection, light-guiding and transparency. The transparency of W-shaped blind can reach 74%, while that of curved blind with teeth can reach 88%. But these blinds cannot meet the above season changing and specific needs—Blind is demanded to keep higher transparency while low solar elevation angle, and while more sunlight is required to guide into room, the blind has to be close to prevent glare.

German patent (DE10016587A1) introduces V-shaped and W-shaped advertising shutter. Transparency of such fixed shutter is about 56%. It reflects a part of sunlight back to the outdoor space to avoid overheating and glare, and guides some sunlight into deep room to make the whole room illuminated evenly. However such fixed shutter has two problems: 1. sunlight gets into the indoor space when solar elevation angle is lower than 25 degree, incurring glare, hence another scroll window shade should be installed to keep out the sunlight in such case; 2. to guide part of sunlight around some range of solar elevation angle into the indoor space to light up whole room regardless of season or other specific factors may cause the indoor space too bright and overheating.

SUMMARY OF THE INVENTION

Technical problem to be solved by this invention: a kind of multi-V-shaped slats combination blind, which can optimize blocking or guiding sunlight flexibly according to different seasons, weather conditions, and personalized demands, can illuminate room evenly by natural sunlight, avoid glare, avoid overheating in summer, and obtain more solar energy for indoor heating in winter.

The specific techniques in this invention are as follows: A multi-slat combination blind of rotating type consists of main slats and rotating slats. Main slat is composed of the outside part and the inside part, joint section is the edge of the outside part meets that of the inside part at the width direction. The included angle between the outside part and the horizontal plane is $\gamma_1$, and the included angle between the inside part and the horizontal plane is $\gamma_2$. The rotating slat is hinged above the main slat, which is driven by the mechanism system.

Two rotating slats as mentioned above wherein the first rotating slat and the second rotating slat are hinged at any position above the main slat.

The cross section of said main slat is symmetrically V-shaped, and the rotating slat is hinged at the bottom of V-shape of the main slat.

The cross section of said main slat is asymmetrically V-shaped. The cross section of said outside part and inside part of the main slat is arc.

The cross section of said main slat, whereof the outside part is plane, and the inside part is arc.

The included angle between said outside part of the main slat and the horizontal plane is $-35° \leq \gamma_1 \leq 35°$, the included angle between said inside part of the main slat and the horizontal plane is $-35° \leq \gamma_2 \leq 35°$. Anticlockwise is positive, and clockwise is negative.

The included angle between said outside part of the main slat and the horizontal plane is, the included angle between said inside part of the main slat and the horizontal plane is $0° \leq \gamma_2 \leq 90°$. Anticlockwise is positive, and clockwise is negative.

The said multi-slat blind has sun-shading slat that is set under the main slat and may be furled close to the underside of the main slat, and can be spread to block or retro-reflect part of sunlight back to the outdoor space when solar elevation angle is low in winter and summer.

A V-shaped advertising bracket is set at the underside of the main slat, and sun-shading component is installed on the bottom of V-shaped advertising bracket.

The upper side of the main slat is covered by micro-teeth partly or wholly.

The first and the second surfaces of the rotating slat are covered by micro-teeth partly or wholly.

The micro-teeth of the said are retro-reflection teeth, including two adjacent orthogonal surfaces: the first tooth surface and the second tooth surface. The variation range of included angle $\alpha_H$ between the second tooth surface, which plays a role of retro-reflecting to sunlight, and the horizontal plane is $90°(\beta_{ia'}+H)/2 \leq \alpha_H \leq 90°-(\beta_{ia}+H)/2$, wherein H is solar elevation angle, $\beta_{ia'}$ is the included angle between the line, linking any edge on the upper side of the slat and the edge on the outdoor space of the underside of the adjacent upper slat, and the horizontal plane, $\beta_{ia}$ is the included angle between the line, linking any edge on the upper side of the slat and the edge on the outdoor space, and the horizontal plane.

The said micro-teeth are forward or backward teeth, which includes two adjacent orthogonal surfaces: the first and the second tooth surface. The variation range of included angle $\alpha_H$ between the second tooth surface, which plays a role of guiding direct light into room, and the horizontal plane is $(\beta_{ic}-H)/2 \leq \alpha_H \leq (\beta_{ic'}-H)/2$, wherein H is solar elevation angle, $\beta_{ic}$ is the included angle between the line, linking any edge on the upper side of a slat and the edge on the indoor space of the slat, and the horizontal plane, $\beta_{ic'}$ is the included angle between the line, linking any edge on the upper side of a slat and the edge on the indoor space of the underside of the adjacent upper slat, and the horizontal plane.

The uniqueness of the invention: all kinds of blinds—sun-shading and light-guiding system composed of any V-shaped rotating multi-slat, can optimize blocking and guiding sunlight according to different seasons and personalized requirements, can fit different demands for sunlight in summer and winter, can keep high transmission either with high or low solar elevation angle to satisfy people's visual needs—good view through window. Current commercial blinds have to be adjusted frequently according to solar elevation angle changing in daytime while these new sunlight self-adapting blinds only can be operated twice a day, which is benefit for intelligent control. Combine multi-slat blind of rotating type and V-shaped advertising bracket to take the place of traditional advertising curtain wall. Traditional advertising curtain wall blocks light and wind while new designed advertising blind can solve such problem so that room behind it can obtain natural ventilation, good viewing, and sunlight illumination.

DETAILED DESCRIPTION OF THE INVENTION

Referring to the figures and embodiments, the invention is described in detail as follows.

Embodiment 1

Figure 1A:
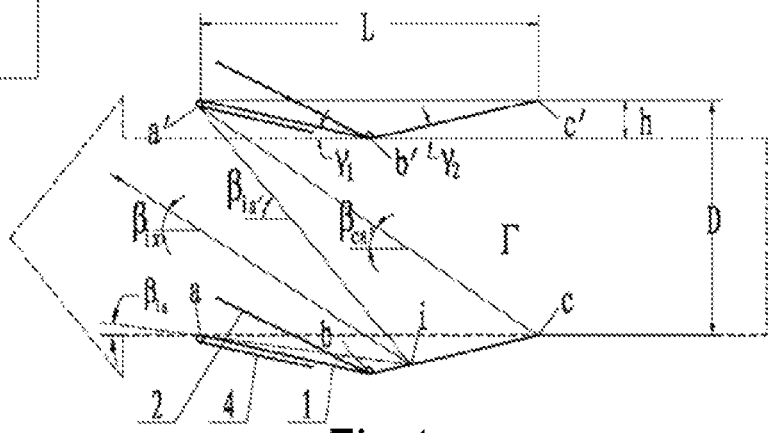
FIG. 1*a*-FIG. 1*c* Cross section of symmetrical V-shaped blind, angles and dimensions definition ($-35° \leq \gamma_1 \leq 35°$, $-35° \leq \gamma_2 \leq 35°$), FIG. 2*a*-FIG. 2*d* Schematic diagrams of action and sunlight reflection of two symmetrical V-shaped slats blind ($-35° \leq \gamma_1 \leq 35°$, $-35° \leq \gamma_2 \leq 35°$ over 1.8 m above indoor ground) according to different solar elevation angle, FIG. 3*a*-FIG. 3*d* Schematic diagrams of action and sunlight reflection of two symmetrical V-shaped slats blind ($-35° \leq \gamma_1 \leq 35°$, $-35° \leq \gamma_2 \leq 35°$ below 1.8 m above indoor ground) according to different solar elevation angle, FIG. 4*a*-FIG. 4*d* Schematic diagrams of action and sunlight reflection of three symmetrical V-shaped slats blind ($-35° \leq \gamma_1 \leq 35°$, $-35° \leq \gamma_2 \leq 35°$ over 1.8 m above indoor ground) according to different solar elevation angle, FIG. 5*a*-FIG. 5*d* Schematic diagrams of action and sunlight reflection of three symmetrical V-shaped slats blind ($-35° \leq \gamma_1 \leq 35°$, $-35° \gamma_2 \leq 35°$ below 1.8 m above indoor ground) according to different solar elevation angle, FIG. 6*a*-FIG. 6*d* Definition of micro-teeth type and tooth face angles on curved surface that retro-reflects and guides sunlight, FIG. 7*a*-FIG. 7*d* Schematic diagram of two-slat combination blind, symmetrical V-shape ($-35° \leq \gamma_1 \leq 35°$, $-35° \leq \gamma_2 \leq 35°$) and asymmetrical V-shape ($0 \leq \gamma_1 \leq 90°$, $0 \leq \gamma_2 \leq 90°$), FIG. 8*a*-FIG. 8*b* Type and distribution of micro-teeth on surface of two symmetrical V-shaped slats combination blind, FIG. 9*a*-FIG. 9*f* Type and distribution of micro-teeth on surface of two line-shaped (plane) slats combination blind, FIG. 10*a*-FIG. 10*b* Type and distribution of micro-teeth on surface of two upside down V-shaped slats combination blind, FIG. 11*a*-FIG. 11*c* Type and distribution of micro-teeth on surface of two curved slats combination blind, FIG. 12*a*-FIG. 12*c* Type and distribution of micro-teeth on surface of two wave-shaped slats combination blind, FIG. 13 Type and distribution of micro-teeth on surface of three symmetrical V-shaped slats combination blind, FIG. 14*a*-FIG. 14*d* Schematic diagrams of two symmetrical V-shaped ($\gamma_1=-5°$, $\gamma_2=5°$) slats combination blind retro-reflects and guides sunlight according to different solar elevation angle H in summer and winter, FIG. 15*b*-FIG. 15*d* Schematic diagrams of three symmetrical V-shaped ($\gamma_1=-5°$, $\gamma_2=5°$) slats combination blind retro-reflects and guides sunlight according to different solar elevation angle H in summer and winter, FIG. 16*a*-FIG. 16*f* Six kinds of combinations of asymmetrical V-shaped and rotating slats for two-slat combination blind, FIG. 17*a*-FIG. 17*c* Definition of angles for two asymmetrical V-shaped slats combination blind ($\gamma_1 \leq 0$, $\gamma_2 \leq 0$), FIG. 18*a*-FIG. 18*d* Relation between slats, type and distribution of micro-teeth on slats, schematic diagrams of action and sunlight reflection of two asymmetrical V-shaped slats combination blind ($\gamma_1=-55°$, $\gamma_2=18°$ over 1.8 m above indoor ground) according to different solar elevation angle, FIG. 19*a*-FIG. 19*d* Relation between slats, type and distribution of micro-teeth on slats, schematic diagrams of action and sunlight reflection of two asymmetrical V-shaped slats combination blind ($\gamma_1=-55°$, $\gamma_2=18°$ below 1.8 m above indoor ground) according to different solar elevation angle, FIG. 20*a*-FIG. 20*d* Schematic diagrams of two asymmetrical V-shaped ($\gamma_1=-55°$, $\gamma_2=18°$) slats combination blind retro-reflects and guides sunlight according to different solar elevation angle H in summer and winter, FIG. 21*a*-FIG. 21*c* Three kinds of combinations of two symmetrical V-shaped slats combination blind and advertising bracket, FIG. 22*a*-FIG. 22*c* Definition of angles for symmetrical V-shaped blind ($\gamma_1 \leq 0$, $\gamma_2 \leq 0$) with advertising bracket, FIG. 23*a*-FIG. 23*d* Relation between slats, type and distribution of micro-teeth on slats, schematic diagrams of action and sunlight reflection of two symmetrical V-shaped slats combination blind ($\gamma_1=-18°$, $\gamma_2=18°$ over 1.8 m above indoor ground) with advertising bracket ($\gamma_1$=−55°, $\gamma'_2$=18° according to different solar elevation angle, FIG. 24*a*-FIG. 24*d* Relation between slats, type and distribution of micro-teeth on slats, schematic diagrams of action and sunlight reflection of two symmetrical V-shaped slats combination blind ($\gamma_1$=−18°, $\gamma_2$=18° below 1.8 m above indoor ground) with advertising bracket ($\gamma_1$=−55°, $\gamma'_2$=18° according to different solar elevation angle, FIG. 25*a*-FIG. 25*d* Schematic diagrams of two symmetrical V-shaped slats combination blind ($\gamma_1$=−18°, $\gamma_2$=18° with advertising bracket ($\gamma_1$=−55°, $\gamma'_2$=18°) retro-reflects and guides sunlight according to different solar elevation angle H in summer and winter, FIG. 26*a*-FIG. 26*c* Three hinge locations between the sun-shading slat and the main slat.
Figure 1B:
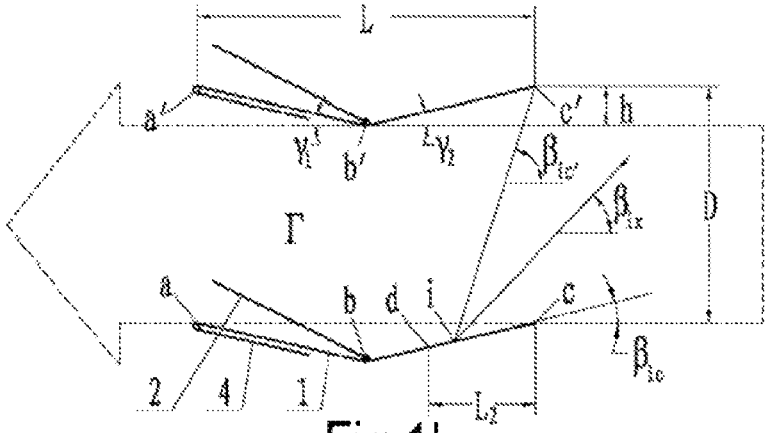
Figure 1C:
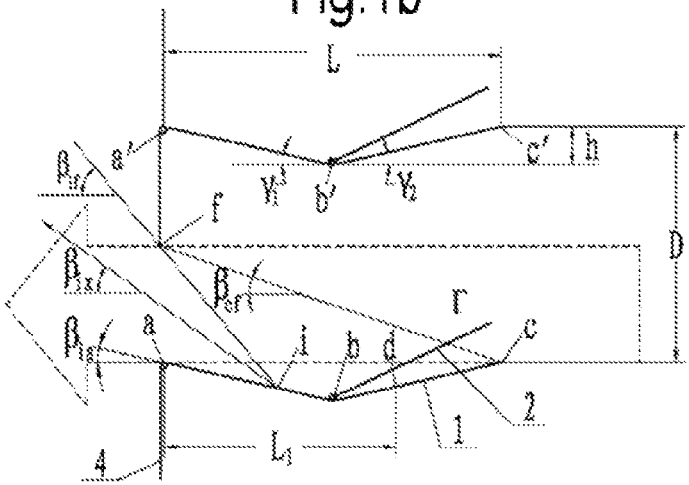
Figure 2A:
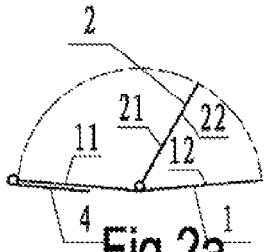
Figure 3A:
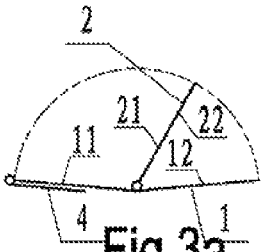
Figure 2B:
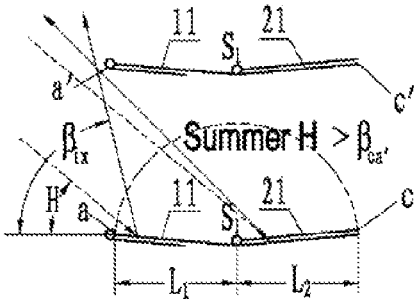
Figure 3B:
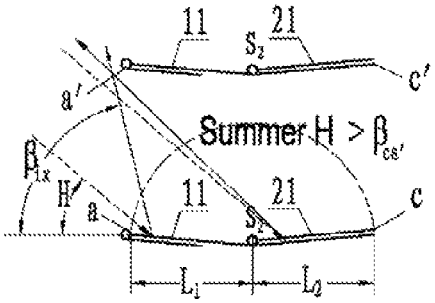
Figure 2C:
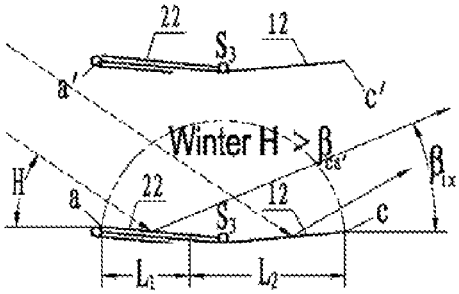
Figure 3C:
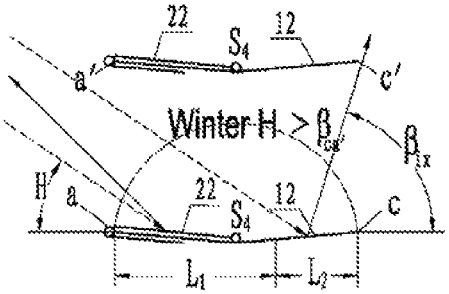
Figure 2D:
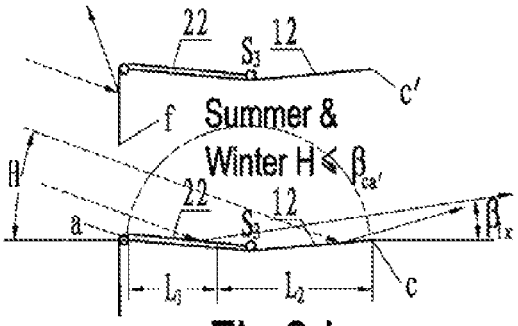
Figure 3D:
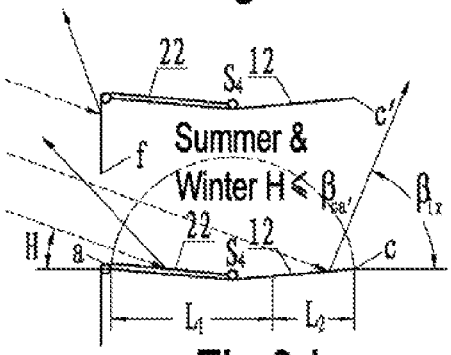
Figure 4A:
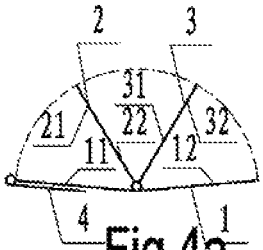
Figure 5A:
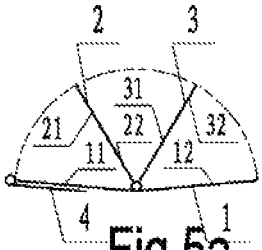
Figure 4B:
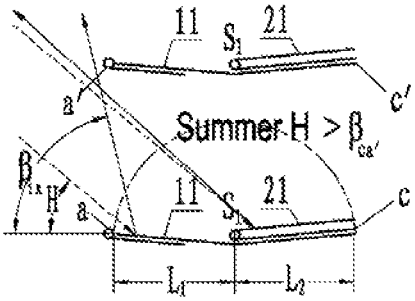
Figure 5B:
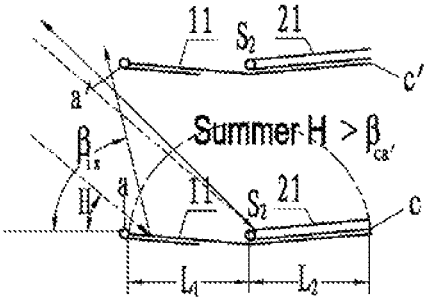
Figure 4C:
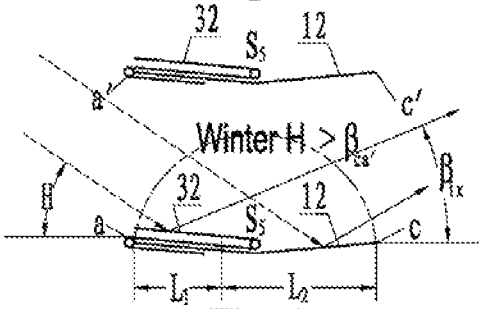
Figure 5C:
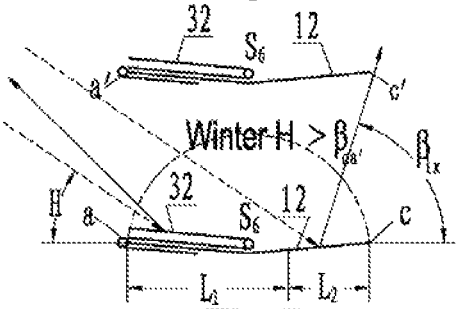
Figure 4D:
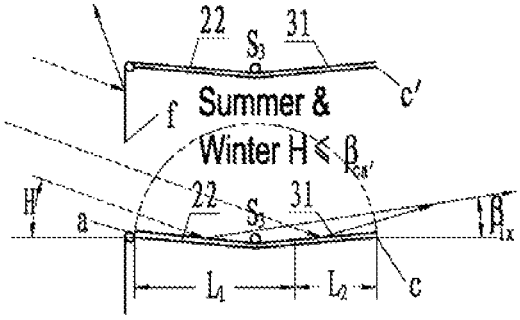
Figure 5D:
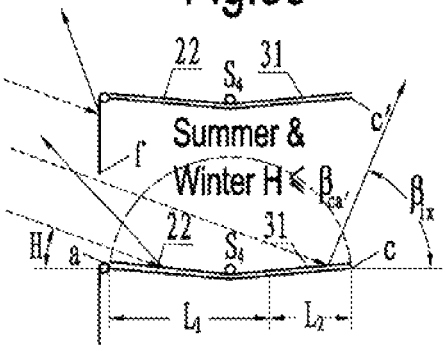

FIG. 1 shows cross section (in the width direction) giving definition of geometric shape, angles and dimensions of symmetrical V-shaped blind, wherein L is the width of blind 1, that is horizontal distance between the edge a on the outdoor space and the edge c on the indoor space. Pitch D is the distance between two adjacent slats 1, that is vertical distance between edges c on the indoor space of two adjacent slats. The best ratio between the pitch D and the width L is 0.7, h is vertical distance between the highest edge c and the lowest edge b' on the slat, and F is the transparency of blind ($\Gamma$=1−h/D) shown as hidden-lined arrow in FIG. 1. $L_1$ is the horizontal distance between the edge d on the upper side of the slat (how to select the point is described following) and the edge a on the outdoor space of the slat. $L_2$ is the horizontal distance between the said edge d and the edge c on the indoor space of the slat. $\beta_{ca'}$ in FIG. 1*a* is the included angle between the line, linking the edge c on the indoor space of the slat 1 and the edge a' on the outdoor space of the slat 1, and the horizontal plane. $\beta_{ia'}$ is the included angle between the line, linking any edge i on the upper side of the slat 1 and the edge a' on the outdoor space of the adjacent upper slat 1 and the horizontal plane. $\beta_{ia}$ is the included angle between the line, linking any edge i on the upper side of the slat 1 and the edge a on the outdoor space of the slat 1, and the horizontal plane. $\beta_{ix}$ is the included angle between reflected light at any edge i of the slat and the horizontal plane. $\beta_{ic'}$ in FIG. 1*b* is the included angle between the line, linking any edge i on the upper side of the slat 1 and the edge c' on the indoor space of the adjacent upper slat 1, and the horizontal plane. $\beta_{ic}$ is the included angle between the line, linking any edge i on the upper side of the slat 1 and the edge c on the indoor space of the slat 1, and the horizontal plane. $\beta_{ix}$ is the included angle between reflected light at any edge i of the slat and the horizontal plane. $\beta_{cf}$ in FIG. 1*c* is the included angle between the line, linking the edge c on the indoor space of the slat 1 and the free edge f of full spread sun-shading component, and the horizontal plane. $\beta_{if}$ is the included angle between the line, linking any edge i of the slat 1 and the free edge f of full open sun-shading component, and the horizontal plane.

FIG. 2 and FIG. 3 respectively shows relation between slats and schematic diagrams of action and sunlight reflection of two symmetrical V-shaped slats combination blind with sun-shading slat according to three different solar elevation angle H (H is the included angle between solar incident direction and the horizontal plane). Solar elevation angle is divided into three: in summer is H>$\beta_{ca'}$ (See FIG. 2*b* and FIG. 3*b*), in winter is H>$\beta_{ca'}$ (See FIG. 2*c* and FIG. 3*c*) and in winter & summer is H≤$\beta_{ca'}$ (See FIG. 2*d* and FIG. 3*d*). Referring to FIG. 2, slats are over 1.8 m above indoor ground. FIG. 3 shows slats below 1.8 m above indoor ground, FIG. 3*a* shows connection between two rotating slats combination blind with sun-shading slat and the surface IDs, FIG. 3*b* shows sunlight reflection on the slat when solar elevation angle is H>$\beta_{ca'}$ in summer, i.e. the included angle $\beta_{ix}$ between the reflected light on the slat and the horizontal plane is $(\beta_{ia}+H)/2 \le \beta_{ix} \le (\beta_{ia'}+H)/2$, FIG. 3*c* shows relationship between the sunlight reflection and the slat when solar elevation angle is H>$\beta_{ca'}$ in winter, i.e. the included angle $\beta_{ix}$ between the guided light and the horizontal plane is: $90°+(\beta_{ic}-H)/2 \le \beta_{ix} \le 90°+(\beta_{ic'}-H)/2$, FIG. 3*d* shows relationship between the sunlight and the slat when solar elevation angle is H≤$\beta_{ca'}$ in winter & summer, i.e. the included angle $\beta_{ix}$ between the reflected light on the outside part of the slat and the horizontal plane is: $(\beta_{ia}+H)/2 \le \beta_{ix} \le (\beta_{if}+H)/2$, and the included angle $\beta_{ix}$ between the guided light on the inside part of the slat and the horizontal plane is: $90°+(\beta_{ic}-H)/2 \le \beta_{ix} \le 90°+(\beta_{ic'}-H)/2$.

Referring to FIGS. 2 and 3, two symmetrical rotating slats combination blind is composed of the main slat 1, the rotating slat 2, the sun-shading component 4 and the driving system (not shown in figure). The main slat 1 is composed of the outside part 11 and the inside part 12. In this embodiment, widths of two portions 11, 12 are the same, so that the cross section of the main slat is symmetrical V-shaped (along the width direction), whereof the radius is the width of the said edges, $\gamma_1$ is the included angle between the outside part 11 of the main slat 1 and the horizontal plane (see FIG. 1*a*-FIG. 1*d*), $\gamma_2$ is the included angle between the inside part 12 of the main slat 1 and the horizontal plane. The variable range of $\gamma_1$ and $\gamma_2$ is respectively $-35° \le \gamma_1 \le 35°$ and $-35° \le \gamma_2 \le 35°$, wherein anti-clockwise is positive, clockwise is negative. The upper side of the main slat 1 may be smooth or micro-toothed (smaller saw teeth) (see FIG. 6, FIG. 8 to FIG. 13), and the underside is smooth. The upper side 21 and the underside 22 of the rotating slat 2 may be smooth or micro-toothed. In this embodiment, the main slat 1 can lift up-down but not rotate, and the rotating slat 2 set on the slat 1 is rotating plane slat or curved slat that has the same shape as that of the second or the outside part of the main slat 1, and whose width is equal to its attached second or outside part of the main slat 1. One end of rotating slat 2 is hinged on the main slat 1 at the middle of bottom line of V-shape. When solar elevation angle H is high in summer (H>$\beta_{ca'}$), the rotating slat 2 is turned backward close to the inside part of the main slat 1, and the sun-shading component 4 is furled. The first surface 21 of the rotating slat 2 and the outside part 11 of the main slat 1 constitute a combination surface, whereon micro-teeth reflect sunlight back to the outdoor space. When solar elevation angle H is high in winter (H>$\beta_{ca'}$), the rotating slat 2 is turned forward close to the outside part of the main slat 1, and the sun-shading component 4 is furled. The second surface 22 of the rotating slat 2 and the outside part 12 of the main slat 1 constitute combination surface, whereon micro-teeth guide sunlight into the indoor space wholly or partly, the rest light is reflected back to the outdoor space. When solar elevation angle H is low in winter and summer (H≤$\beta_{ca'}$), the rotating slat 2 is turned forward close to the inside part of the main slat 1, and the sun-shading component 4 is spread, part of sunlight is reflected back to the outdoor space. The second surface 22 of the rotating slat 2 and the outside part 12 of the main slat 1 constitute combination surface, whereon micro-teeth reflect sunlight to the outdoor space wholly or partly, the rest light is guided to the indoor space.

Referring to FIG. 4-FIG. 5, three symmetrical rotating V-shaped slats combination blind ($-35°\leq\gamma_1\leq35°$, $-35°\leq\gamma_2\leq35°$) improves the said two-slat combination blind. Comparing to two-slat combination blind, three-slat blind has two rotating slats: the rotating slat 2 and 3, one end of the rotating slat 2 and 3 hinged on the bottom of the V-shaped slat 1. When solar elevation angle is $H>\beta_{ca'}$ in summer, the rotating slat 2 is turned backward and the rotating slats 2 and 3 are both turned close to the inside part 12 of the main slat 1, meanwhile the sun-shading component 4 is furled, so that the first surface 21 of the rotating slat 2 and the outside part 11 of the main slat 1 constitute a surface, micro-teeth on it reflect all sunlight back to the outdoor space. When solar elevation angle is $H>\beta_{ca'}$ in winter, the rotating slat 3 is turned forward and the rotating slats 2 and 3 are turned close to the outside part 11 of the main slat 1, and the sun-shading component 4 is furled, so that second surface 32 of the rotating slat 3 and the inside part 12 of the main slat 1 constitute a surface, micro-teeth on it guide all light into the indoor space, or guide part into the indoor space and block the rest back to the outdoor space. When solar elevation angle is $H\leq\beta_{ca'}$ in winter and summer, the rotating slat 2 is turned forward, the rotating slat 3 is turned backward, and the sun-shading component 4 is spread to block sunlight, so that the first surface 31 of the rotating slat 3 and the second surface 22 of the rotating slat 2 constitute a surface, micro-teeth on it guide all sunlight into the indoor space, or guide part into the indoor space and reflect the rest back to the outdoor space.

Sun-shading component 4 may be sun-shading slat 4, and the shape of sun-shading slat 4 is the same as that of the main slat 1. Sun-shading slat 4 may be a rotating plane slat or arc-shaped slat, and its surface is smooth or micro-toothed. Sun-shading slat 4 is installed at any place on the back (i.e. the underside) of the main slat 1.

Figure 26A:
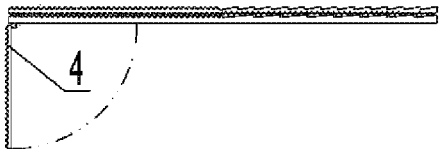
Figure 26B:
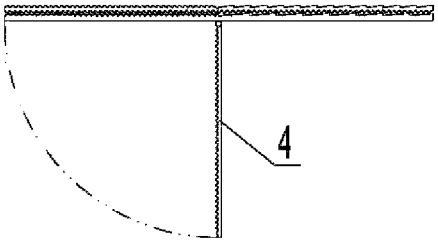
Figure 26C:
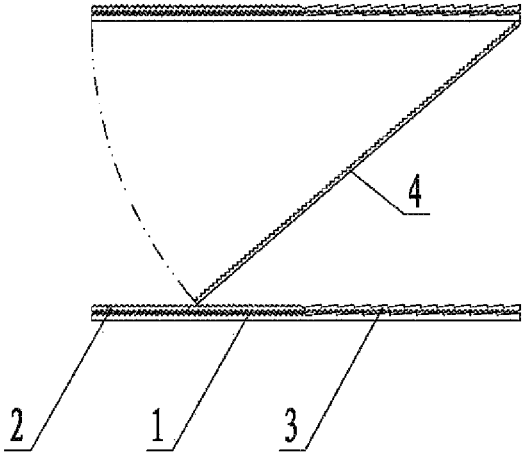

Referring to FIG. 26, three different locations of the sun-shading slat 4 hinged on three-slat combination blind are the edge on the outdoor space, the middle edge and the edge on the indoor space of the main slat 1, that is to say, sun-shading slat may be located at different locations according to different requirements.

Width of the sun-shading slat 4 is determined by solar elevation angle $H=\beta_{cf}$, normally, it is able to block sunlight while H varies from 20° to 35°. If $\beta_{cf}=20°$ is taken, draw an oblique line passing through the edge c on the indoor space of the slat 1, $\beta_{cf}$ being the angle with the horizontal plane, then draw a vertical line passing through the edge a' on the outdoor space of the adjacent upper main slat 1, and these two lines intersect at f. Distance d from a' to f is the width of cross section of the sun-shading slat 4 (See FIG. 1).

Surface of the sun-shading blind 4 may be smooth or micro-toothed that can retro-reflect light (see FIG. 26).

Figure 6A:
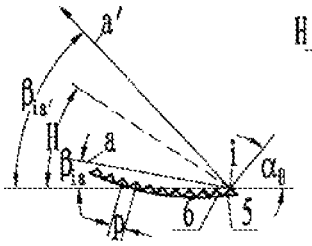
Figure 6B:
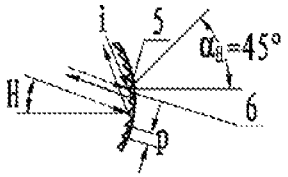
Figure 6C:
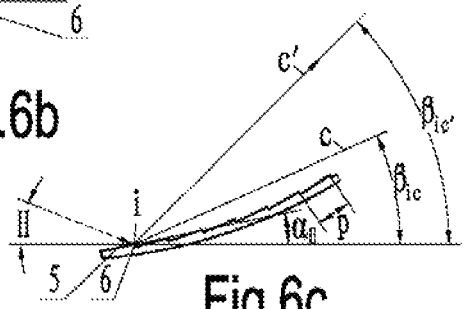
Figure 6D:
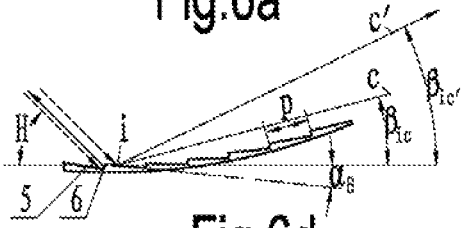

Micro-teeth on surface of the slat are divided into two: one type is to retro-reflect sunlight, and the other is to guide sunlight. FIG. 6*a*-FIG. 6*d* defines micro-teeth types and angles of the slat which retro-reflects and guides sunlight. FIG. 6*a* is definition of geometry and angles of micro-teeth on arbitrary surface (so called retro-reflection teeth), which play a role of retro-reflecting direct light. FIG. 6*b* is definition of geometry and angles of micro-teeth (retro-reflection teeth) on arbitrary vertical surface, which play a role of retro-reflecting direct light. FIG. 6*c* is definition of geometry and angles of micro-teeth (so called forward teeth) on arbitrary surface, which reflect and guide sunlight. FIG. 6*d* is definition of geometry and angles of micro-teeth (so called backward teeth) on arbitrary surface, which reflect and guide sunlight. Widths p of all kinds of teeth are the same. The first tooth surface 6 and the second tooth surface 5 are adjacent and orthogonal. The included angle $\alpha_H$ between the surface 5, reflecting sunlight back to the outdoor space, and the horizontal plane is $90°-(\beta_{ia'}+H)/2\leq\alpha_H\leq90°-(\beta_{ia}+H)/2$. The included angle $\alpha_H$ between the surface 5, guiding sunlight into the indoor space, and the horizontal plane is $(\beta_{ic}-H)/2\leq\alpha_H\leq(\beta_{ic'}-H)/2$, wherein H is solar elevation angle. The second tooth surface 5 of retro-reflection teeth reflects sunlight back to the outdoor space directly, or reflects sunlight to the first tooth surface 6 then the surface 6 reflects it to the outdoor space, or on the contrary. So that sunlight is not allowed to convert to heat on the slat that plays a role of sun-shading. It is generally used when solar elevation angle H is high ($H>\beta_{ca'}$) in summer. The second tooth surface 5 of forward teeth is much wider than the first tooth surface 6, the surface 5 guides sunlight falling on it to the indoor space for illuminating and heating (sunlight will not fall on the first tooth surface 6 generally). Forward tooth is used when solar elevation angle H is high ($H>\beta_{ca'}$) in winter or solar elevation angle H is low ($H\leq\beta_{ca'}$) in winter & summer. The second tooth surface 5 of backward teeth is much wider than the first tooth surface 6, and these two tooth surfaces play completely different role to sunlight. Part of sunlight is reflected back to the outdoor space by the second tooth surface 5, the rest sunlight is reflected to the first tooth surface 6 then guided into the indoor space by the first tooth surface 6. Backward tooth is used when solar elevation angle H is maximum (H=45°) in winter, so that sunlight will not be reflected to the edge c' on the indoor space of the adjacent upper slat. To deal with sunlight when solar elevation angles are different in different seasons, the upper side of slat has various types: 1. wholly smooth surface (the edge d is the middle along the width direction of slat), 2. Part of it is smooth surface, the rest is toothed (e.g. the edge on the outdoor space is backward teeth, the edge on the indoor space is smooth, the edge d is junction between the said two parts), 3. Part of it is one kind of micro-teeth, the rest is another different kind of micro-teeth (e.g. the edge on the outdoor space is retro-reflection teeth, the edge on the indoor space is forward teeth, the edge d is junction between the said two parts), 4. Slat is covered by the same kind of micro-teeth (e.g. all are retro-reflection teeth; the edge d is middle along the width direction of the slat).

Figure 9A:
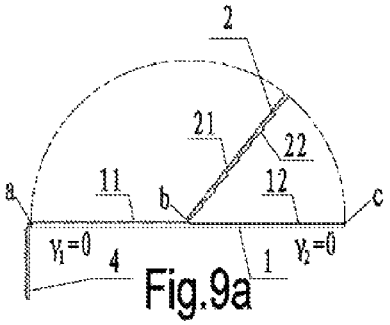
Figure 9B:
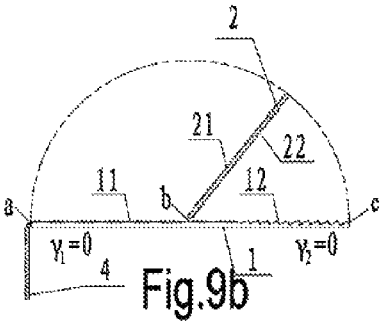
Figure 9C:
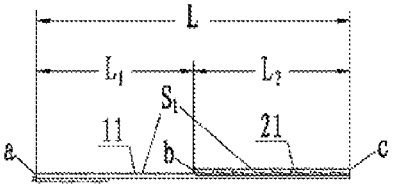
Figure 9D:
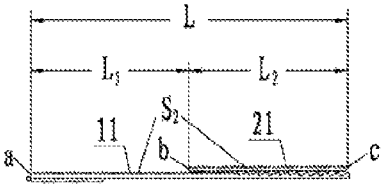
Figure 9E:
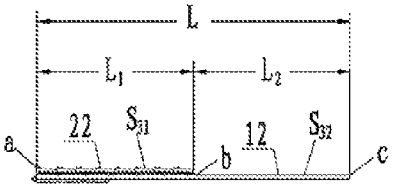
Figure 9F:
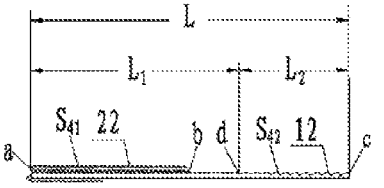

According to three different solar elevation angle areas, surface of two V-shaped rotating slats combination blind has different micro-teeth (referring to FIG. 2, FIG. 3). Surface S is composed of the main slat 1, the rotating slat 2 and 3. Odd subscript of S is for the slats located over 1.8 m above indoor ground, while even subscript is for the slats located below 1.8 m above indoor ground. $S_1$ is composed of the outside part 11 of the main slat 1 located over 1.8 m above indoor ground and the first surface 21 of the rotating slat 2; $S_3$ composed of the inside part 12 of the main slat 1 and the second surface 22 of the rotating slat 2. $S_2$ is composed of the outside part 11 of the main slat 1 located below 1.8 m above indoor ground and the first surface 21 of the rotating slat 2; $S_4$ composed of the inside part 12 of the main slat 1 and the second surface 22 of the rotating slat 2. For three V-shaped rotating slats combination blind (referring to FIG. 4, FIG. 5), $S_1$ is composed of the outside part 11 of the main slat 1 located over 1.8 m above indoor ground and the first surface 21 of the rotating slat 2, $S_3$ composed of the second surface 22 of the rotating slat 2 and the first surface 31 of the rotating slat 3, $S_5$ composed of the second surface 32 of the rotating slat 3 and the inside part 12 of the main slat 1; $S_2$ is composed of the outside part 11 of the main slat 1 located below 1.8 m above indoor ground and the first surface 21 of the rotating slat 2, $S_4$ composed of the second surface 22 of the rotating slat 2 and the first surface 31 of the rotating slat 3, $S_6$ composed of the surface 32 of the rotating slat 3 and the inside part 12 of the main slat 1. For easy description, divide surface S into the outside part and the inside part at the edge d. Second subscript 1 is for the edge on the outdoor space, whose width is $L_1$ measured from the edge a on the outdoor space of the slat. Second subscript 2 is for the inside part, whose width is $L_2$ measured from the edge c on the indoor space of the slat. FIG. 9 shows micro-teeth type and distribution set on plane slat wherein FIG. 9*a* is toothed slat located over 1.8 m above indoor ground, FIG. 9*b* is toothed slat located below 1.8 m above indoor ground, FIG. 9*c* is surface $S_1$ of slat located over 1.8 m above indoor ground, and FIG. 9*d* is surface $S_2$ of slat located below 1.8 m above indoor ground. Both $S_1$ and $S_2$ are used for solar elevation angle $H>\beta_{ca'}$ in summer, and covered by retro-reflection teeth. The included angle $\alpha_H$ is between the second surface 5 of teeth and the horizontal plane is $\alpha_H=90°-(\beta_{ia'}+H)/2$, wherein $H=\beta_{ca'}$. FIG. 9*e* is surface $S_3$ of the slat which is located over 1.8 m above indoor ground, and is used for solar elevation angle $H>\beta_{ca'}$ in winter or $H\leq\beta_{ca'}$ in summer and winter. The outside part $S_{31}$ of the surface $S_3$ has backward teeth, so that sunlight cannot be reflected to the edge on the indoor space c' of the adjacent upper slat even when solar elevation angle H is maximum (H=45°). The included angle $\alpha_H$ between the second tooth surface 5 of micro-teeth and the horizontal plane is $\alpha_H=(\beta_{ix}-H)/2$, and $(\beta_{ic}-H)/2\leq\alpha_H\leq(\beta_{ic'}-H)/2$, wherein H=45°, width $L_1=0\sim L$. The inside part $S_{32}$ is smooth. FIG. 9*f* is surface $S_4$ of slat which is located below 1.8 m above indoor ground, and is used for solar elevation angle $H>\beta_{ca'}$ in winter or $H\leq\beta_{ca'}$ in summer & winter. The outside part $S_{41}$ has retro-reflection teeth. The included angle $\alpha_H$ between the second tooth surface 5 and the horizontal plane is $\alpha_H=90°-(\beta_{ia}+H)/2$, wherein $H=\beta_{cf'}$, width $L_1=2L/3$. The inside part $S_{42}$ has forward teeth, and the included angle $\alpha_H$ between the second tooth surface 5 and the horizontal plane is $\alpha_H=(\beta_{ic'}-H)/2$, wherein $H=\beta_{ca'}$, width $L_2=L/3$, so that reflected light cannot reach the underside of the adjacent upper slat, and the included angle between the guided light and the horizontal plane is larger than 50° when solar elevation angle is $20°\leq H\leq\beta_{ca'}$.

Referring to FIG. 6*b*, the included angle $\alpha_H$ between the second tooth surface 5 of retro-reflection teeth laying on the reflective surface of the sun-shading slat 4 and the horizontal plane is 45°.

Figure 7A:
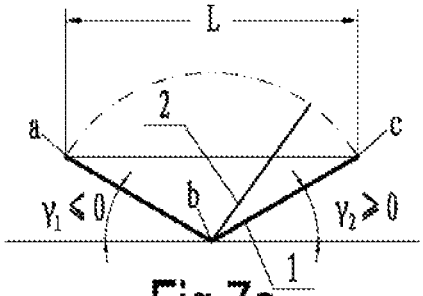
Figure 7B:
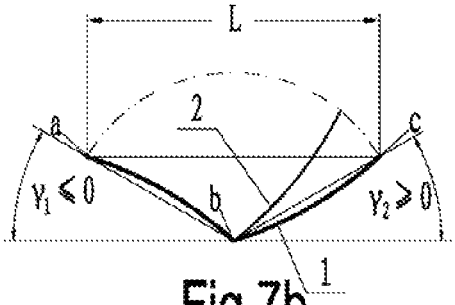
Figure 7C:
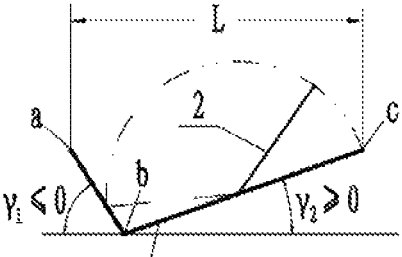
Figure 7D:
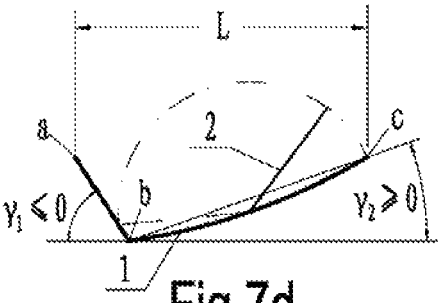
Figure 8A:
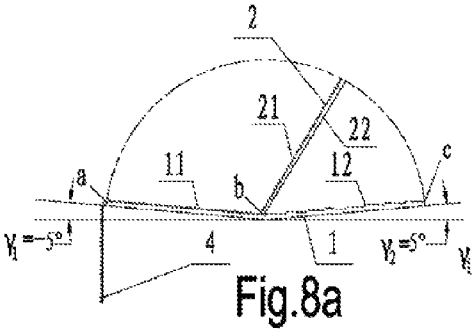
Figure 8B:
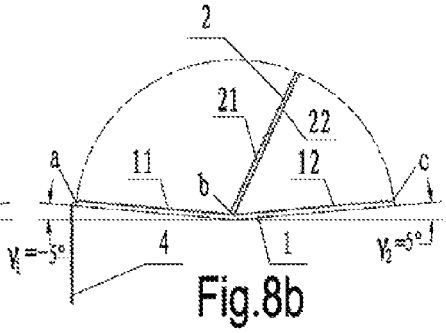
Figure 10A:
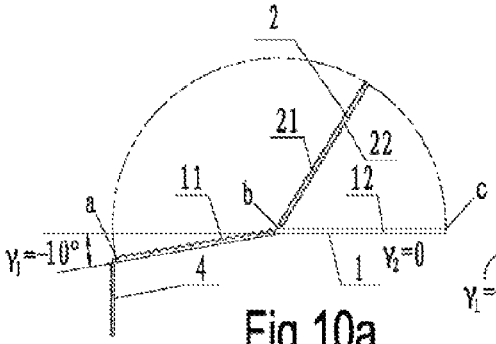
Figure 10B:
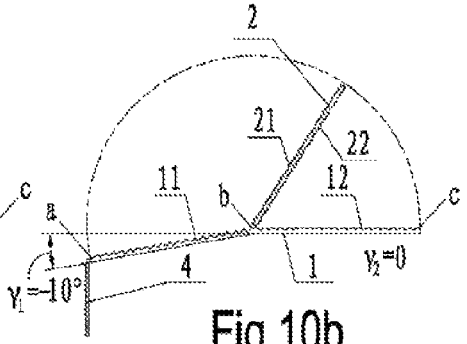
Figure 11A:
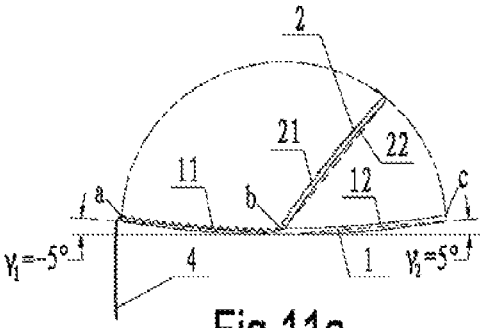
Figure 11B:
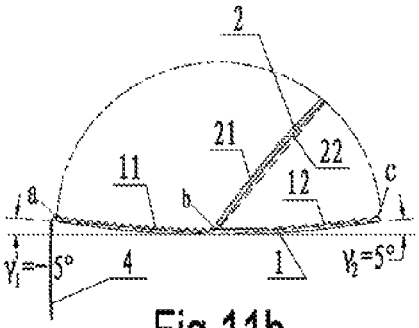

Not only is main slat 1 V-shaped shown in FIG. 7*b*, but also its inside part and outside part can be arc-shaped, approximately being V-shaped. Another shape is combination by line-shaped outside part and arc-shaped inside part. FIG. 7 shows different slat shapes of two symmetrical V-shaped slats combination blind ($-35°\leq\gamma_1\leq35°$, $-35°\leq\gamma_2\leq35°$) and the asymmetrical V-shaped ($-90°\leq\gamma_1\leq0°$, $0\leq\gamma_2\leq90°$). Comparing to FIG. 7*a* and FIG. 7*b*, FIG. 8 to FIG. 12 show the cross section of two V-shaped rotating slats combination blind, type and distribution of micro-teeth according to different solar elevation angle. FIG. 8 is symmetrical V-shape, FIG. 9 is plane slat, FIG. 10 is upside-down V-shape, FIG. 11 is arc-shape, and FIG. 12 is wave-shape. FIG. 8*a*-FIG. 12*a* show slats located over 1.8 m above indoor ground; FIG. 8*b*-FIG. 12*b* show slats located below 1.8 m above indoor ground. Micro-teeth on plane slat in FIG. 9 play the same role as that of FIG. 8*a*-FIG. 12*a* and FIG. 8*b*-FIG. 12*b* as above mentioned.

Figure 11C:
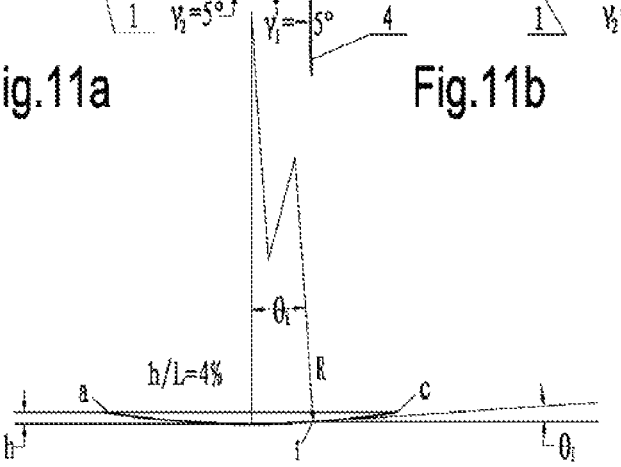
Figure 12A:
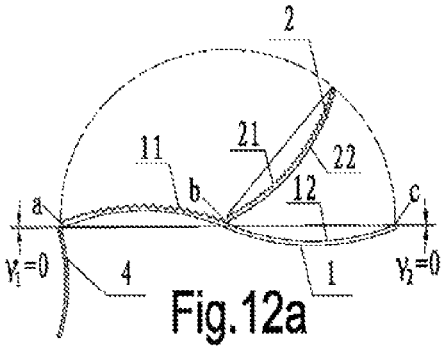
Figure 12B:
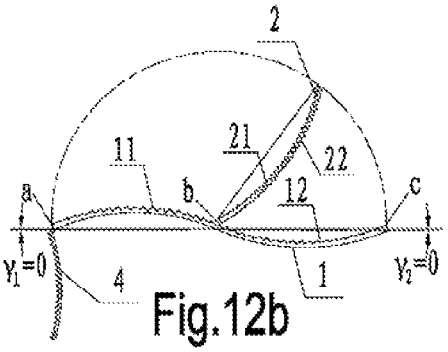
Figure 12C:
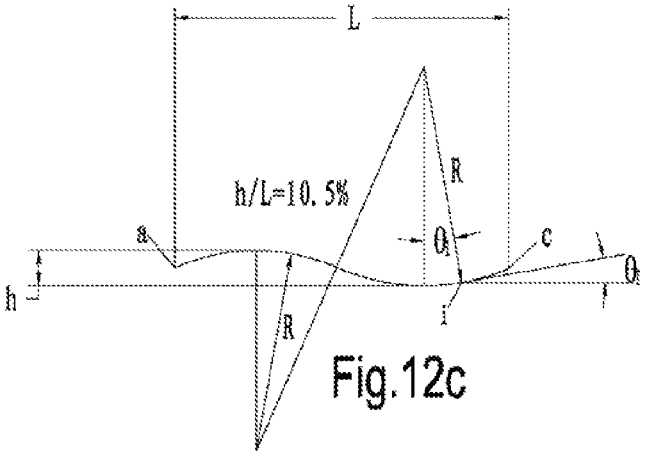

FIG. 11*c* shows the ratio of the choral height h to the choral length L of the arc-shaped slat and, the definition of angle $\theta_i$ between the tangent line passing through any edge i on arc and the horizontal plane. FIG. 12*c* shows the ratio of the sum of two arcs' choral heights h to the choral length L of wave-shaped combination blind, the definition of the included angle $\theta_i$ between the tangent line passing through any edge i on arc and the horizontal plane. The included angle between the normal line passing through this point and the vertical line is equal to $\theta_i$.

Figure 13:
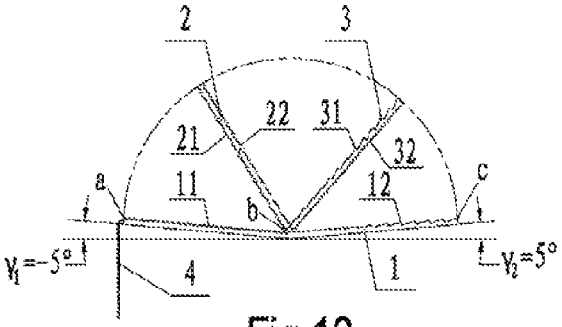
Figure 14A:
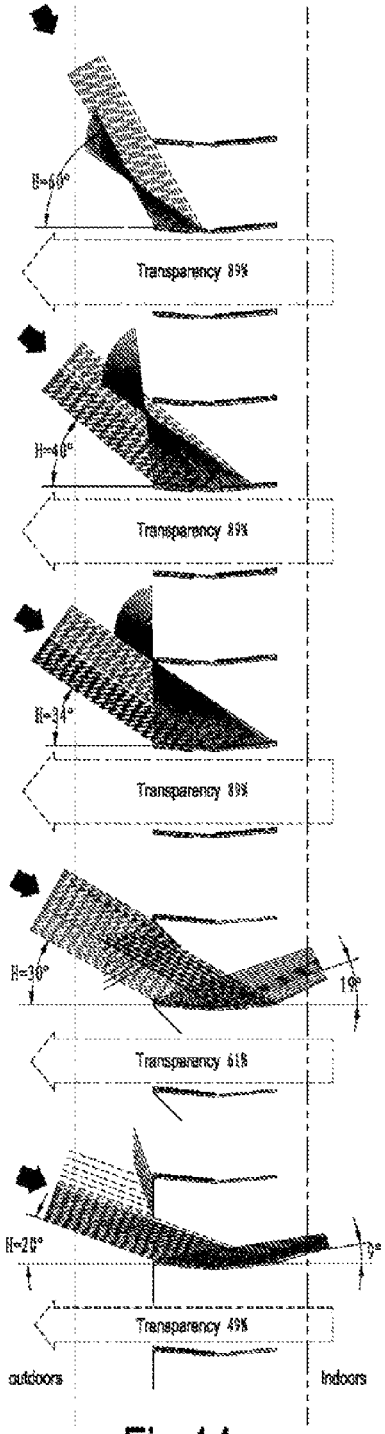
Figure 14B:
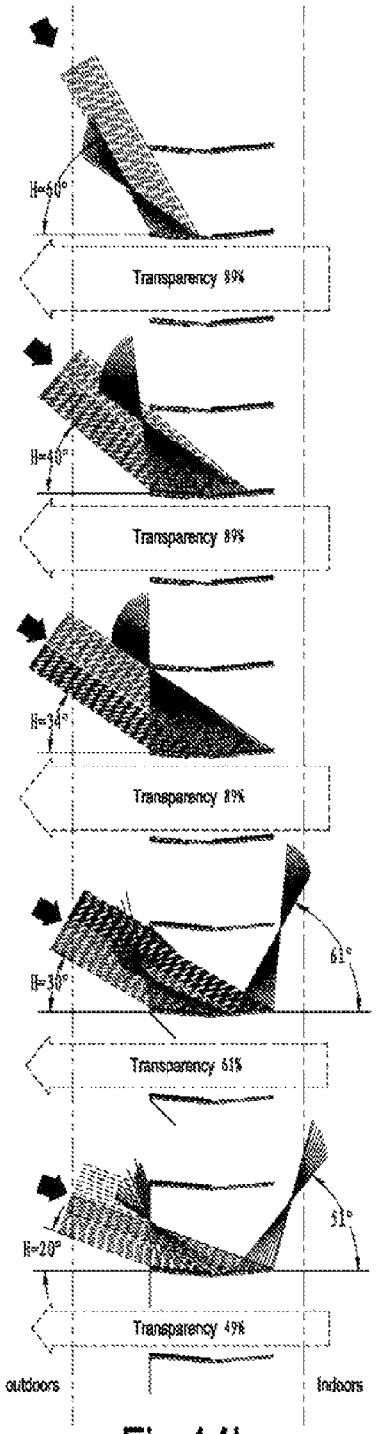
Figure 14C:
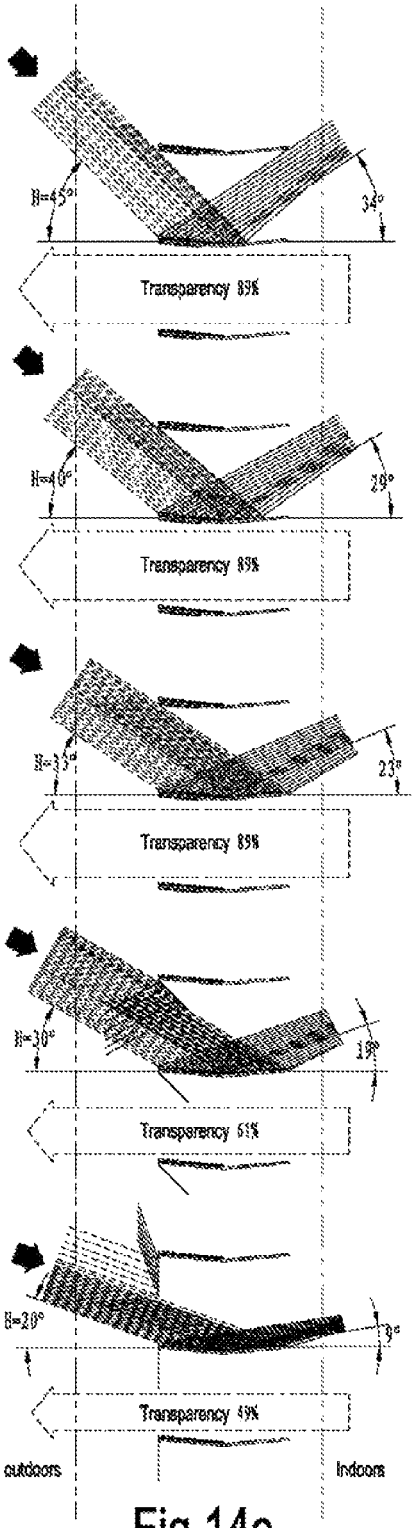
Figure 14D:
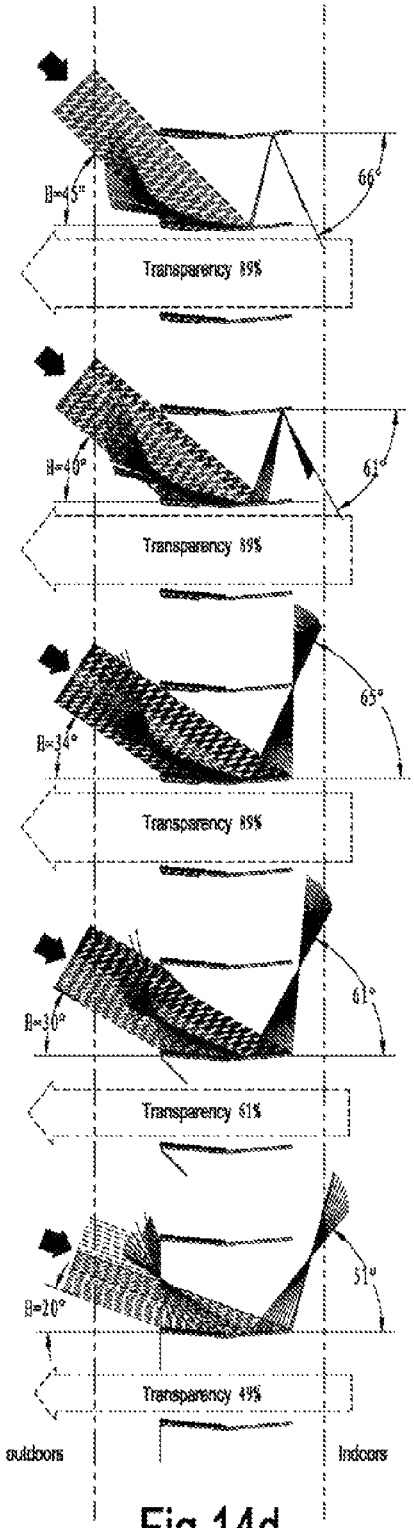
Figure 15B:
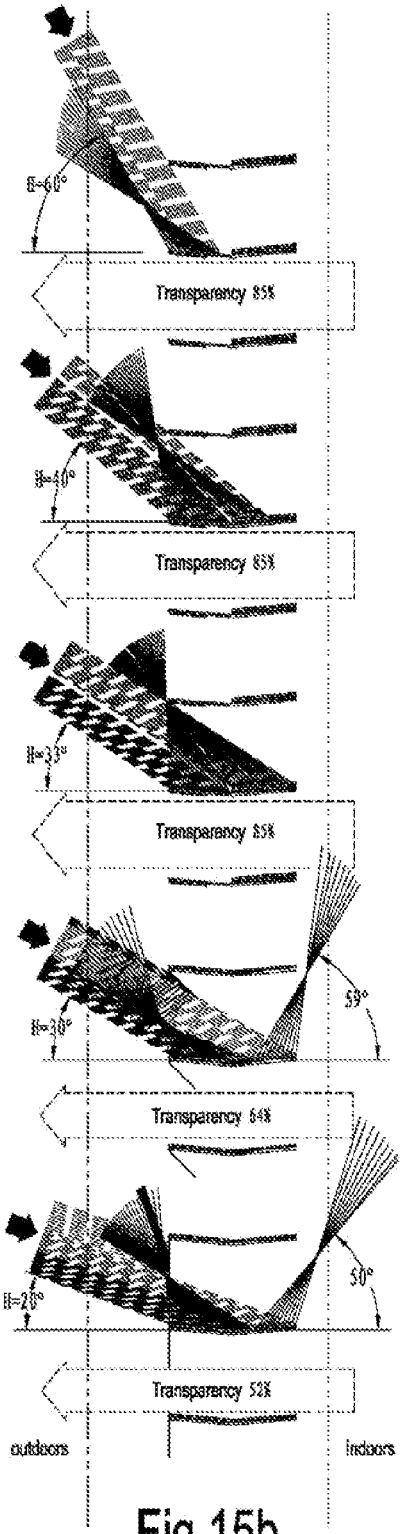
Figure 15D:
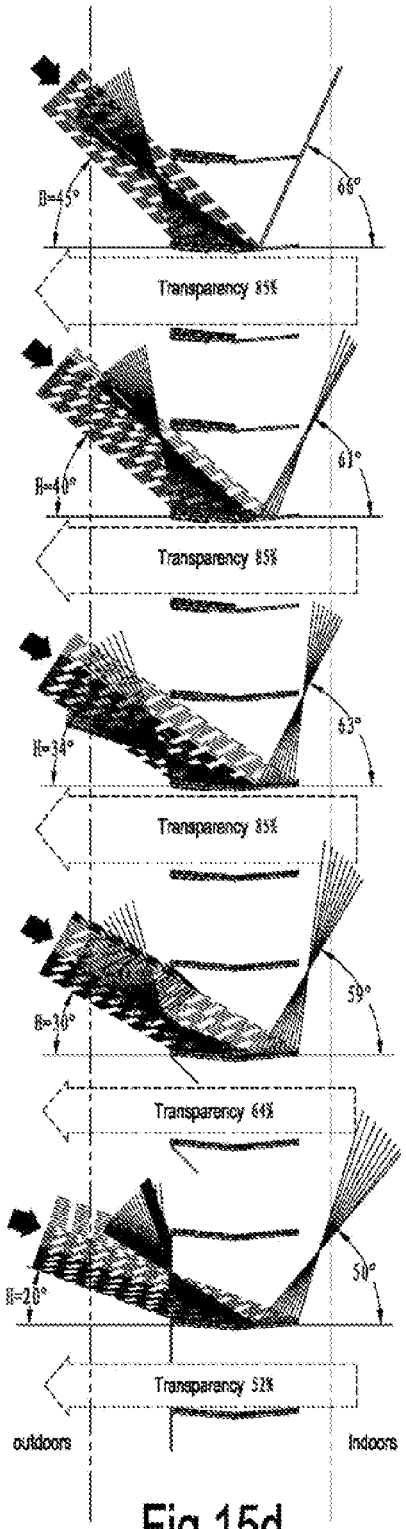
Figure 16A:
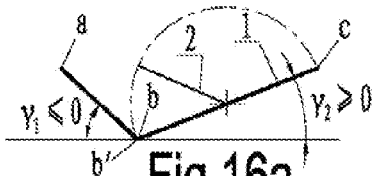
Figure 16B:
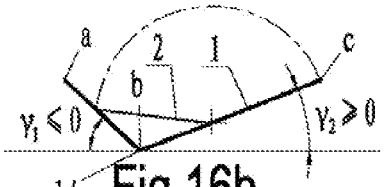
Figure 16C:
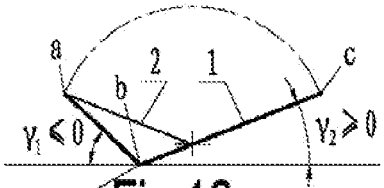
Figure 16D:
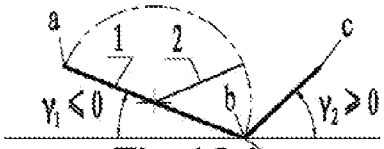
Figure 16E:
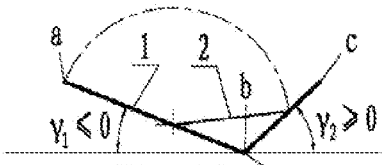
Figure 16F:
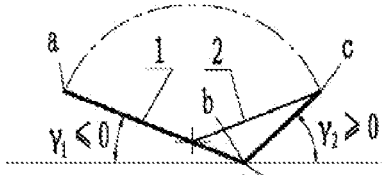

FIG. 14*a*-FIG. 14*d* respectively show schematic diagram of two symmetrical V-shaped slats combination blind of rotating type retro-reflects and guides sunlight according to different solar elevation angle H in summer and winter, dashed lines mean the incident sunlight and solid lines mean the reflected or guided sunlight. FIG. 14*a* shows slats located over 1.8 m above indoor ground, which retro-reflect and guide sunlight according to different solar elevation angle H in summer, FIG. 14*b* shows slats located below 1.8 m above indoor ground, which retro-reflect and guide sunlight according to different solar elevation angle H in summer, FIG. 14*c* show slats located over 1.8 m above indoor ground, which retro-reflect and guide sunlight according to different solar elevation angle H in winter, and FIG. 14*d* shows slats located below 1.8 m above indoor ground, which retro-reflect and guide sunlight according to different solar elevation angle H in winter. Referring to these figures, two symmetrical V-shaped rotating slats combination blinds can optimize the control of retro-reflecting and guiding sunlight depending on seasons and personalized specific needs. While solar elevation angle is $H\leq\beta_{ca'}$ ($\beta_{ca}$+=33°~35°), blinds can also have high transparency (over 50%), and control the amount of retro-reflecting and guiding of sunlight, so as to satisfy the different demands of sunlight in summer and winter. No mater solar elevation angle is high or low, blinds can provide high transparency to meet people's needs for visual communication with outside scenery. Comparing to recent commercial sun-shading blinds, these blinds are self-adaptive to sunlight, and only need to be handled twice in a day to avoid the trouble of frequently adjusting as time goes by and easy for intelligent controlling (for two-slat with plane, upside-down V-shape, arc-shape and wave-shape, the schematic diagrams of reflecting and guiding light are the same as that of V-shape slat. They are not shown in the figures.). Referring to these figures, while solar elevation angle is $H\geq\beta_{ca'}$ in winter, small part of sunlight is reflected to the edge c' on the indoor space (horizontal distance L/4 from the edge c on the indoor space) of slats located below 1.8 m above indoor ground, and results in glare. To get rid of glare, the underside of slat may be frosted or coated to prevented reflection, or the area with width $L_2=L/4$ from the edge c on the indoor space of the underside of the slat is covered by forward or backward teeth, and the included angle between the second tooth surface 5 and the horizontal plane is $-16°\leq\alpha_H\leq3°$, enlarging the included angle between the reflected light and the horizontal plane. Alternative suggestion is to add one more rotating slat 3 to two rotating slats combination blind located below 1.8 m above indoor ground to form a three rotating slats combination blind referring to FIG. 5 and FIG. 13. FIG. 13 shows type and distribution of micro-teeth on surface of three symmetrical V-shaped rotating slats combination blind for various solar elevation angles. When solar elevation angle is $H>\beta_{ca'}$ in summer, the surface $S_2$ composed of the outside part 11 of the main slat 1 and the first surface 21 of the rotating slat 2 is covered by retro-reflection teeth. The included angle $\alpha_H$ between the second tooth surface 5 and the horizontal plane is $\alpha_H=90°-(\beta_{ia'}+H)/2$, wherein $H=\beta_{ca'}$. When solar elevation angle is $H>\beta_{ca'}$ in winter, the outside part $S_{61}$ of the surface $S_6$ composed of the inside part 12 of the main slat 1 and the second surface 32 of the rotating slat 3 is covered by retro-reflection teeth. The included angle $\alpha_H$ between the second tooth surface 5 and the horizontal plane is $\alpha_H=90°-(\beta_{ia'}+H)/2$, wherein $H=\beta_{ca'}$, width $L_1=2L/3$, while the inside part $S_{62}$ is covered by forward teeth, the included angle $\alpha_H$ between the second tooth surface 5 and the horizontal plane is $\alpha_H=(\beta_{ic'}-H)/2$, wherein H=45°, width $L_2=L/3$, so that, even when solar elevation angle is $\beta_{ca'}<H\leq 45°$, sunlight will not be reflected to area around the edge c' on the indoor space of the underside of the adjacent upper main slat 1, and the included angle between guided light and the horizontal plane is above 50°. When solar elevation angle is $H\leq\beta_{ca'}$ in winter and summer, the outside part $S_{41}$ of the combination surface composed of the second surface 22 of the rotating slat 2 and the first surface 31 of the rotating slat 3 is covered by retro-reflection teeth, and the included angle $\alpha_H$ between the second tooth surface 5 and the horizontal plane is $\alpha_H=90°-(\beta_{if}+H)/2$, wherein $H=\beta_{cf}$, width $L_1=2L/3$, while the inside part $S_{42}$ is covered by forward teeth, and the included angle $\alpha_H$ between the second tooth surface 5 and the horizontal plane is $\alpha_H=(\beta_{ic'}-H)/2$, wherein $H=\beta_{ca'}$, width $L_2=L/3$, so that, even when solar elevation angle is $\beta_{cf}\leq H\leq\beta_{ca'}$, sunlight will not be reflected to area around the edge c' on the indoor space on the underside of the adjacent upper main slat 1, and the included angle between guided light and the horizontal plane is above 50°. FIG. 15 shows schematic diagrams of three symmetrical V-shaped rotating slats combination blind retro-reflects and guides sunlight according to different solar elevation angle H in summer and winter, which is located below 1.8 m above indoor ground, wherein FIG. 15*b* is for summer and FIG. 15*d* is for winter. Referring to these figures, for two-slat combination blind with sun-shading component, sunlight will not be reflected to area around the edge c' on the indoor space of the adjacent upper main slat 1 when solar elevation angle is $H>\beta_{ca'}$ in winter.

Embodiment 2

Figure 17A:
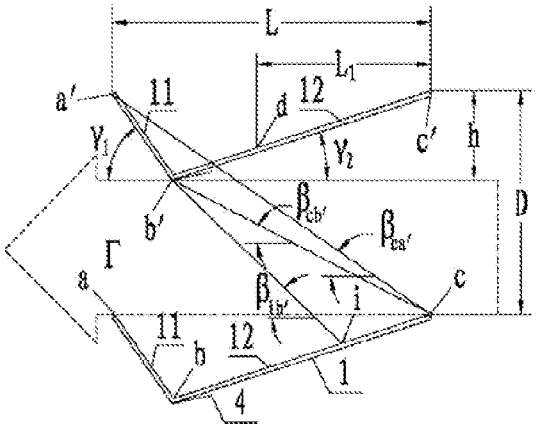
Figure 17B:
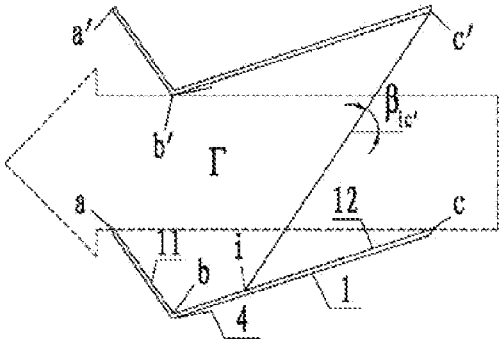
Figure 17C:
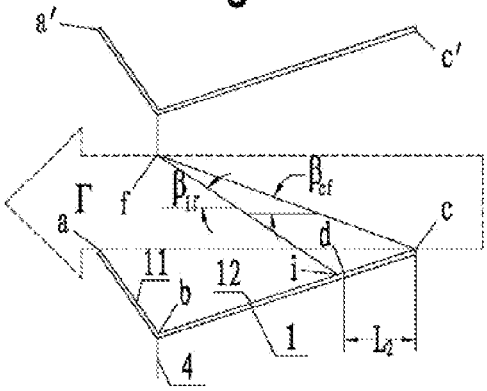
Figure 18A:
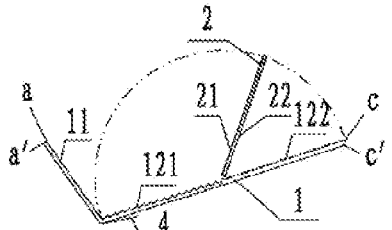
Figure 18B:
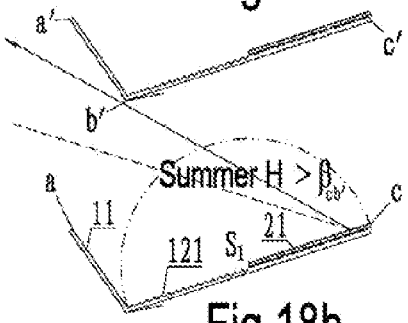
Figure 18C:
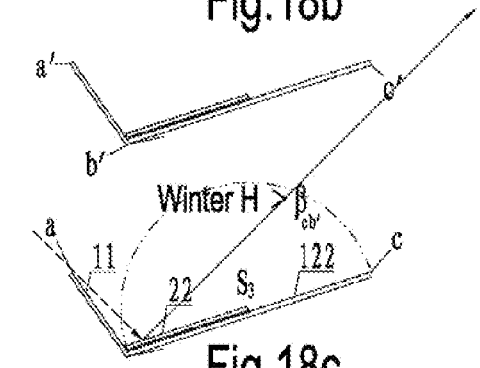
Figure 18D:
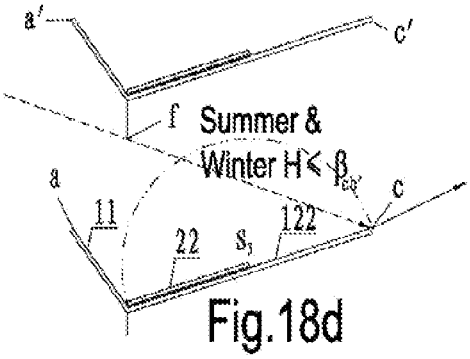
Figure 19A:
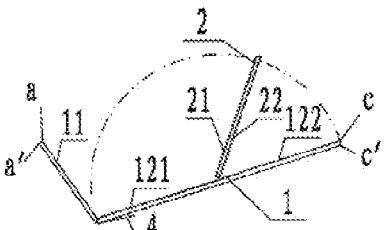
Figure 19B:
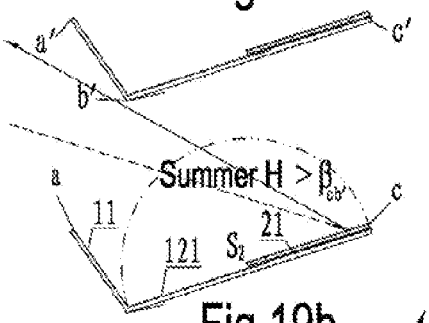
Figure 19C:
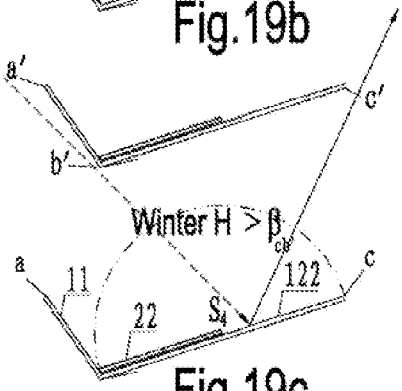
Figure 19D:
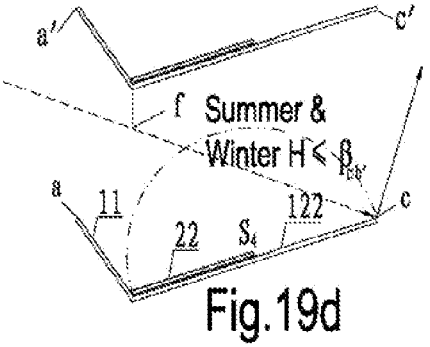
Figure 20A:
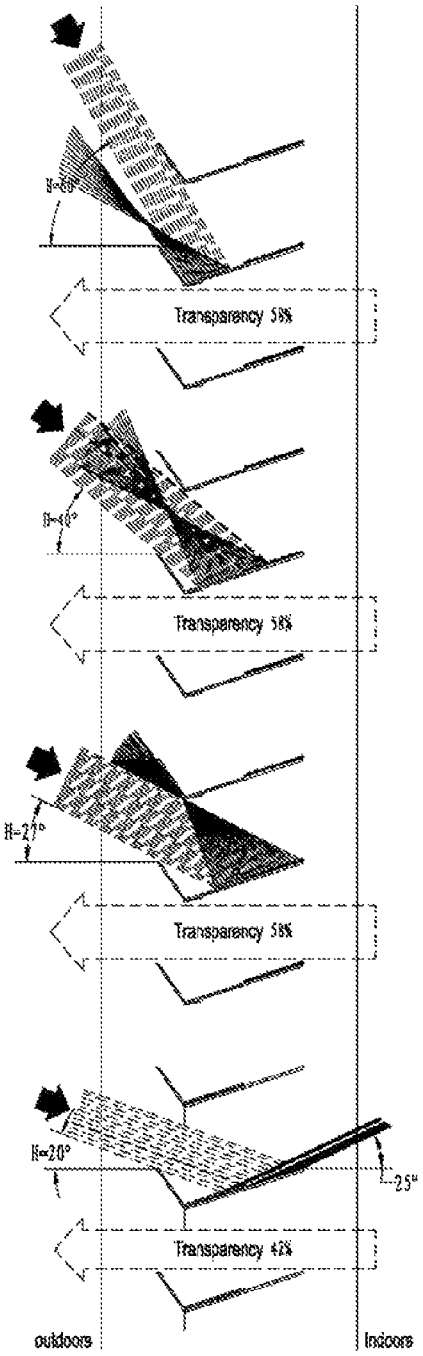
Figure 20B:
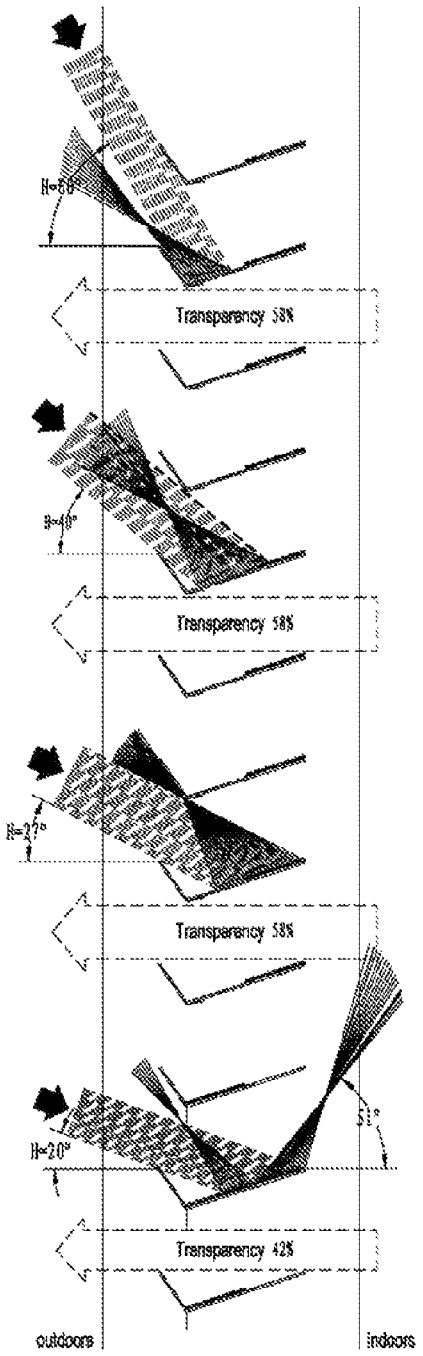
Figure 20C:
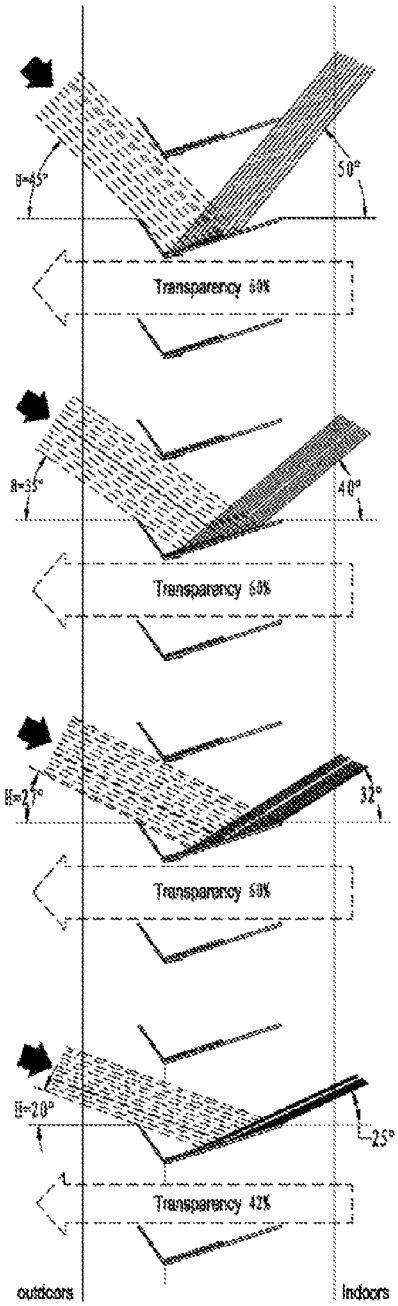
Figure 20D:
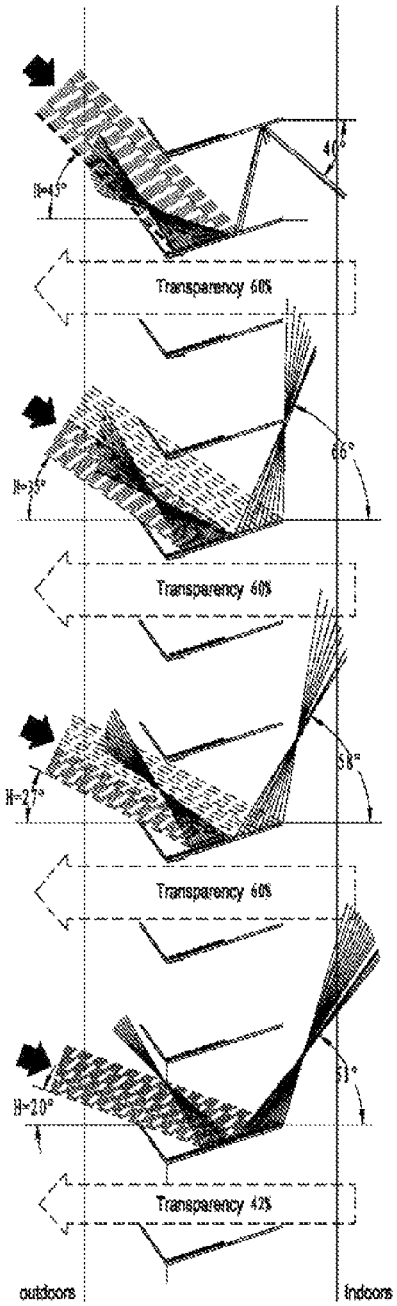

Embodiment 1 shows a symmetric V-shaped main slat 1, i.e. the vertical line passing through the bottom of V-shape is symmetry axis, the second and the outside part are equal width, and the rotating slat 2 is as wide as each portion of the V-shaped main slat; the rotating slat 2 is hinged at the bottom of V-shaped main slat. When main slat is asymmetrical V-shape (rough V-shape), the edge on the outdoor space and the edge on the indoor space of the V-shaped main slat are on the same horizontal plane, and the rotating shaft is not at the bottom of V-shape but any edge on one portion of the slat. FIG. 7*c* and FIG. 7*d* show asymmetric V-shaped combination blind with main slat and rotating slat. FIG. 16 shows its specific geometries and FIG. 17-FIG. 19 show combination structures and diagrams of FIG. 16*a*. FIG. 17 shows definitions of angles for two asymmetrical V-shapes slats combination blind ($\gamma_1\leq 0$, $\gamma_2\geq 0$), where $\gamma_1$, is the included angle between the outside part 11 of the main slat 1 and the horizontal plane, $\gamma_2$ is the included angle between the inside part 12 of the main slat 1 and the horizontal plane, and $\gamma_1$ and $\gamma_2$ ranges $-90°\leq\gamma_1\leq 0°$ and $0°\leq\gamma_2\leq 90°$, anticlockwise is positive and clockwise is negative. $\beta_{cb'}$ is the included angle between the line, linking the edge c of the main slat 1 and the V-shape bottom b' of the adjacent upper main slat 1, and the horizontal plane, $\beta_{ib'}$ is the included angle between the line, linking any edge i of the main slat 1 and the V-shape bottom b' of the adjacent upper main slat 1, and the horizontal plane, $L_{bc}$ is horizontal distance from the edge c on the indoor space of the main slat to the limit edge b of the main slat touched by the free edge of the rotating slat 2 when the rotating slat is turned forward (in this Embodiment, b is the bottom of the V-shaped main slat 1), $L_1$ is the horizontal distance from the edge d of slat to the edge b, and $L_2$ is the horizontal distance from the edge d of the slat to the edge c on the indoor space of the main slat 1. The definitions of other angles—$\beta_{ca'}$, $\beta_{ia'}$, $\beta_{ia}$, $\beta_{ic'}$, $\beta_{ic}$, $\beta_{if}$ are the same as that shown in embodiment 1. FIG. 18 and FIG. 19 shows types and distributions of micro-teeth on slats and schematic diagrams of slats' action and sunlight reflection of two asymmetrical V-shaped slats combination blind ($\gamma_1=-55°$, $\gamma_2=18°$) according to different solar elevation angle. FIG. 18 is slats located over 1.8 m above indoor ground, and FIG. 19 is slats located below 1.8 m above indoor ground, FIG. 18*a* and FIG. 19*a* show the connection between each slat and the surface IDs of two asymmetric V-shaped rotating slats combination blind with sun-shading slat. Referring to FIG. 18*b*, the combination surface $S_1$ of the slats located over 1.8 m above ground is composed of the half part 121 on the outdoor space of the inside part 12 of the main slat 1 and the first surface 21 of the rotating slat 2. FIG. 19*b* shows the combination surface $S_2$ of the slats located below 1.8 m above indoor ground is composed of the half part 121 on the outdoor space of the inside part 12 of the main slat 1 and the first surface 21 of the rotating slat 2. Both kinds of slats are used for when solar elevation angle is high $H>\beta_{cb'}$ in summer, and retro-reflection teeth are set on both. The optimization calculation formula for angle $\alpha_H$ between the second tooth surface 5 and the horizontal plane is $\alpha_H=90°-(\beta_{ib'}+H)/2$, where $H=\beta_{cb'}$. FIG. 18*c* and FIG. 18*d* show the surface $S_3$ of the slats located over 1.8 m above indoor ground, which is composed of the half part 122 on the indoor space of the inside part 12 of the main slat 1 and the second surface 22 of the rotating slat 2. The surface $S_3$ is covered by backward teeth, which can reflect and guide sunlight when solar elevation angle is $H>\beta_{cb'}$ in winter, and $H\leq\beta_{cb'}$ in winter and summer, so that sunlight will not be reflected to the underside around the edge c' on the adjacent upper slat when solar elevation angle H is maximum (H=45°) in winter. Optimization calculation formula of angle $\alpha_H$ between the second tooth surface 5 of backward teeth and the horizontal plane is $\alpha_H=(\beta_{ix}-H)/2$, and $(\beta_{ic}-H)/2\alpha_H\leq(\beta_{ic'}-H)/2$, wherein H=45°, width $L_1=L_{bc}$. FIG. 19*c* and FIG. 19*d* show the surface $S_4$ of the slats located below 1.8 m above indoor ground, which is composed of the half part 122 on the indoor space of the inside part 12 of the main slat 1 and the second surface 22 of the rotating slat 2. The outside part $S_{41}$ of the surface $S_4$ is covered by retro-reflection teeth, which retro-reflect light when solar elevation angle is $H>\beta_{cb'}$ in winter, and $H_{cb'}$ in winter and summer. The included angle $\alpha_H$ between the second tooth surface 5 and the horizontal plane is $\alpha_H=90°-(\beta_{if}+H)/2$, wherein $H=\beta_{cf}$, width $L_1=L_{bc}-L/3$. Teeth on the inside part $S_{42}$ turn from backward teeth to forward teeth gradually, which deflects and guides sunlight into the indoor space when solar elevation angle is $H>\beta_{cb'}$ in winter, and $H\leq\beta_{cb'}$ in winter and summer. Calculation formula of angle $\alpha_H$ between the second tooth surface 5 and the horizontal plane is $\alpha_H=(\beta_{IC'}-H)/2$, wherein $H=\beta_{ca'}$, width $L_2=L/3$, so that sunlight will not be reflected to the underside around the edge c' on the indoor space of the adjacent upper slat when solar elevation angle is $\beta_{cf}\leq H\leq\beta_{ca'}$, and the included angle between the guided light and the horizontal plane is larger than 50°.

FIG. 20*a*-FIG. 20*d* show schematic diagrams of two asymmetrical V-shaped rotating slats combination blind ($\gamma_1=-55°$, $\gamma_2=18°$) which retro-reflects and guides sunlight according to different solar elevation angle H in summer and winter. Two asymmetrical V-shaped rotating slats combination blind is used as advertising curtain wall, resulting in low transparency due to its special requirements, and except this, this embodiment has the same optical function with embodiment 1.

In this embodiment, as an inflectional form, the outside part and the inside part of the V-shaped main slat 1 are arc-shape, which makes the slat be V-shape roughly at the width direction. Another inflectional form is that the outside part of the main slat 1 is plane, and the inside part is arc-shape, which makes the slat be V-shape roughly at the width direction.

Figure 21A:
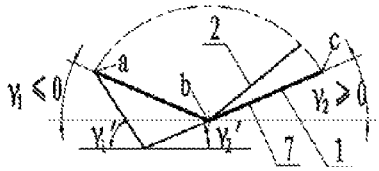
Figure 22A:
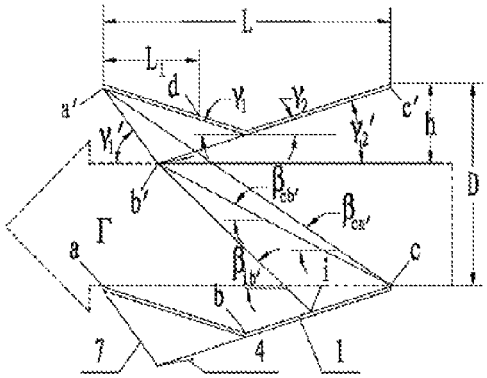
Figure 21B:
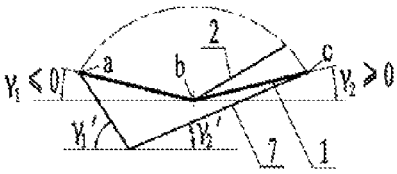
Figure 22B:
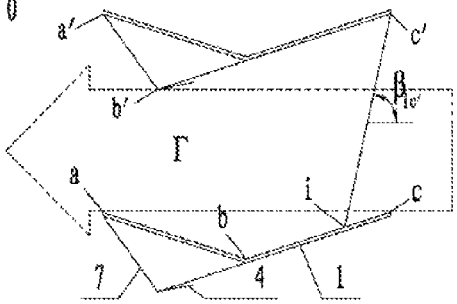
Figure 21C:
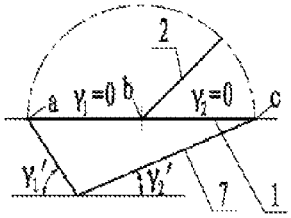
Figure 22C:
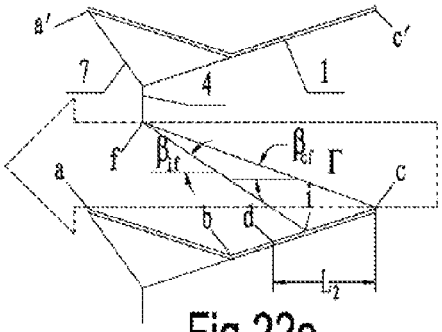
Figure 23A:
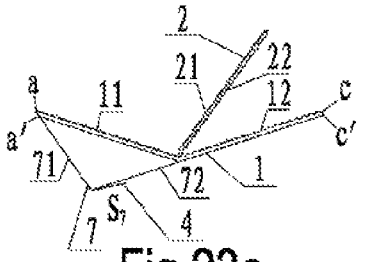
Figure 24A:
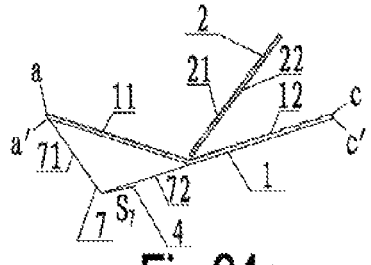
Figure 23B:
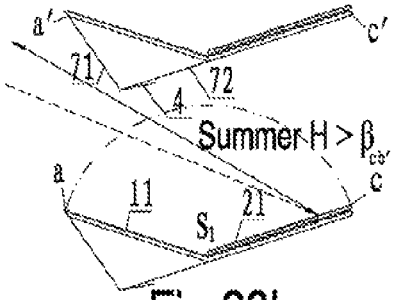
Figure 24B:
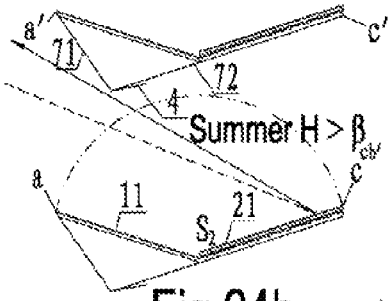
Figure 23C:
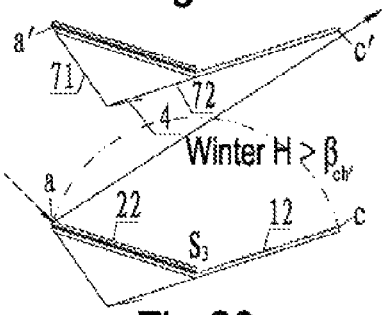
Figure 24C:
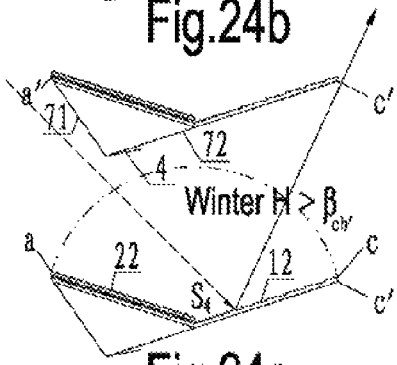
Figure 23D:
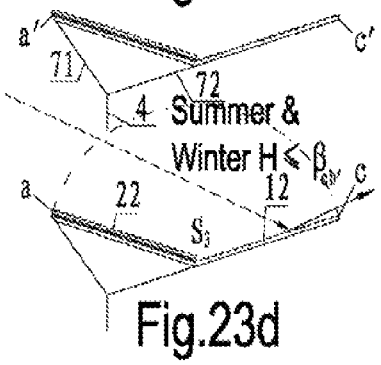
Figure 24D:
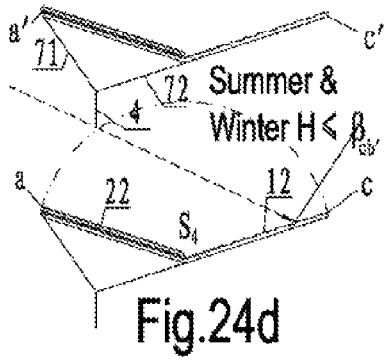
Figure 25A:
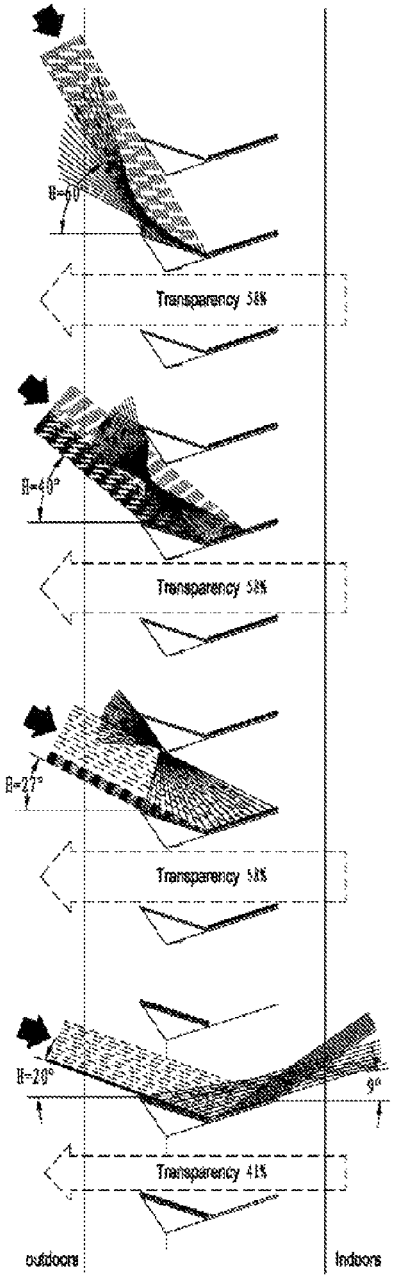
Figure 25B:
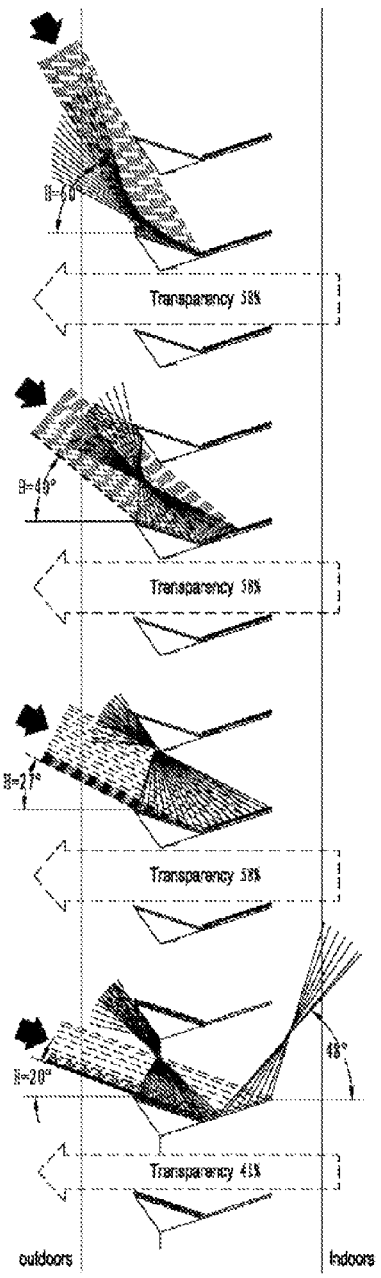
Figure 25C:
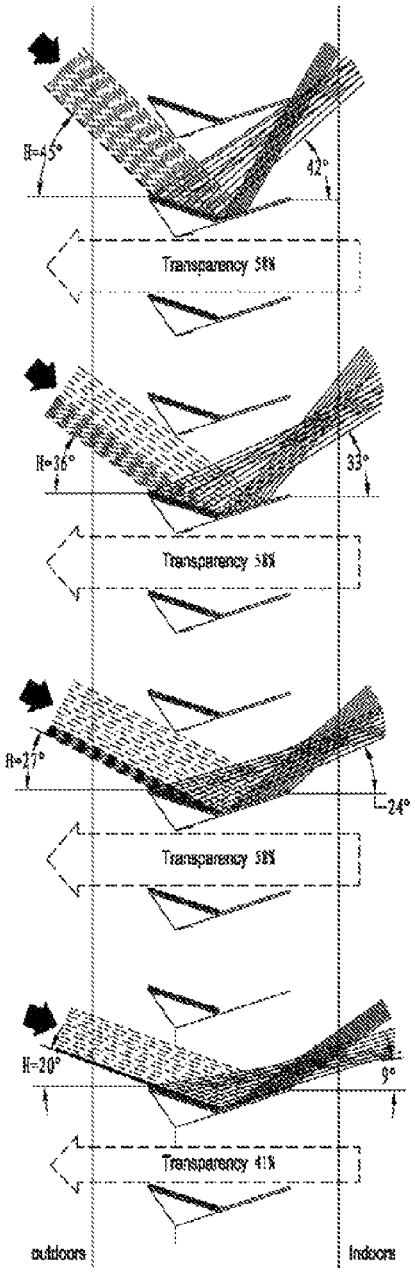
Figure 25D:
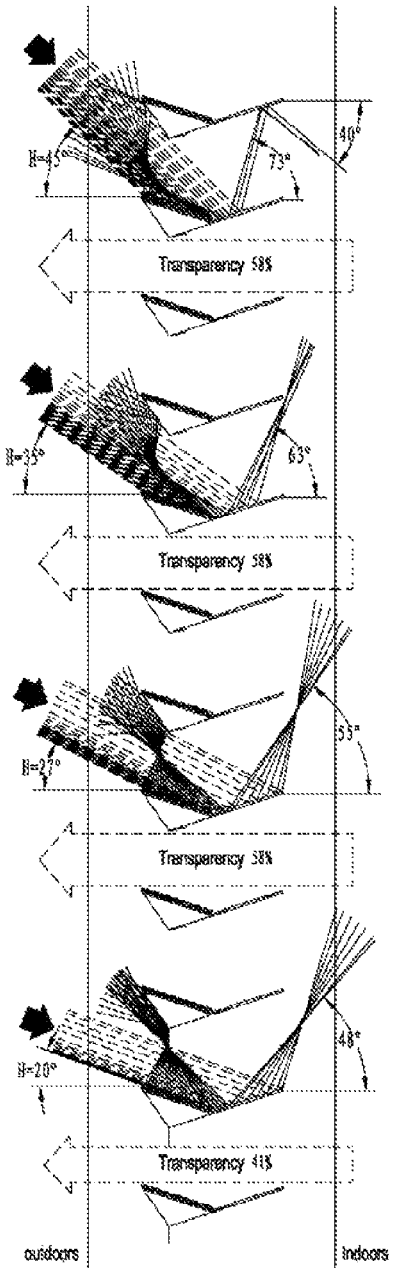

Asymmetrical V-shaped advertising bracket is attached to the underside of two asymmetrical V-shaped rotating slats combination blind and the sun-shading component being set at the bottom of the advertising bracket, which fits various requests of advertising wall on blind. FIG. 21 shows three kinds of advertising blind. FIG. 22-FIG. 24 show connections for blind in FIG. 21*a*. FIG. 22 defines angles of asymmetrical V-shaped blind ($\gamma_1 \leq °$, $\gamma_2 \geq 0°$) with advertising bracket ($\gamma_1' \leq 0°$, $\gamma_2' \geq 0°$), wherein $\gamma_1$ is the included angle between the outside part 11 of the main slat 1 and the horizontal plane, $\gamma_1$ is the included angle between the inside part 12 of the main slat 1 and the horizontal plane, and the value of $\gamma_1$ and $\gamma_2$ is $-35° \leq \gamma_1 \leq 0°$, $0° \leq \gamma_2 \leq 35°$, wherein anticlockwise is positive, clockwise is negative. $\gamma_{1'}$ is the included angle between the outside part 71 of the advertising bracket 7 and the horizontal plane while $\gamma_2'$ is the included angle between the inside part 72 of the advertising bracket 7 and the horizontal plane, and value of $\gamma_1'$ and $\gamma_2'$ is $-90° \leq \gamma_1' \leq 0°$, $0° \leq \gamma_2' \leq 90°$, wherein anticlockwise is positive, clockwise is negative. $L_1$ is the horizontal distance of the edged on the upper side of the slat from the edge a on the outdoor space of the main slat 1, while $L_2$ is the horizontal distance of the edge d from the edge c on the indoor space, and definitions of the other angles—$\beta_{ca'}$, $\beta_{cb'}$, $\beta_{cf}$, $\beta_{ib'}$, $\beta_{ic'}$, $\beta_{if}$ are the same as that of embodiment 1. FIG. 23 shows type and distribution of micro-teeth on slats, schematic diagrams of slats' action and sunlight reflection of two symmetrical V-shaped slats combination blind ($\gamma_1=-18°$, $\gamma_2=18°$) located over 1.8 m above indoor ground with advertising bracket ($\gamma_1=-55°$, $\gamma_2'=18°$) according to different solar elevation angle, while FIG. 24 is for slats located below 1.8 m above indoor ground, wherein FIG. 23*a* and FIG. 24*a* define connection between slats and surface IDs. The combination of surfaces is the same as the embodiment 1, FIG. 23*b* shows the combination surface $S_1$ of the slats located over 1.8 m above indoor ground, and FIG. 24*b* shows the surface $S_2$ of the slats located below 1.8 m above indoor ground, and both are used for solar elevation angle $H>\beta_{cb'}$ in summer. The surfaces $S_1$ and $S_2$ are covered by retro-reflection teeth, and calculation formula for angle $\alpha_H$ optimum value is $\alpha_H=90°-(\beta_{ib'}+H)/2$, wherein $\alpha_H$ is the included angle between the second tooth surface 5 of retro-reflection teeth and the horizontal plane, wherein $H=\beta_{cb'}$. Referring to FIG. 23*c* and FIG. 23*d*, the surface $S_3$ of the slats located over 1.8 m above indoor ground, is used for solar elevation angle $H>\beta_{cb'}$ in winter or $H\leq\beta_{cb'}$ in winter and summer, while the inside part and the outside part of $S_3$ are covered by forward teeth and backward teeth. When solar elevation angle $H=\beta_{cf}$, sunlight will not be reflected to the inside part $S_{32}$, and when H=45°, sunlight will not be reflected to area around the edge c' on the indoor space of the underside of the adjacent upper main slat. Calculation formula for angle $\alpha_H$ optimum value is $\alpha_H=(\beta_{ix}-H)/2$, and $(\beta_{ic}-H)/2\leq\alpha_H\leq(\beta_{ic'}-H)/2$, wherein $\alpha_H$ is the included angle between the second tooth surface 5 of retro-reflection teeth and the horizontal plane, and H=45°, width $L_1=L$. Referring to FIG. 24*c* and FIG. 24*d*, the surface $S_4$ of the slats located below 1.8 m above indoor ground, is used for solar elevation angle $H>\beta_{cb'}$ in winter or $H\leq\beta_{cb'}$ in winter and summer. The outside part $S_{41}$ is covered by retro-reflective teeth. Calculation formula for angle $\alpha_H$ optimum value is $\alpha_H=90°-(\beta_{if}+H)/2$, wherein $H=\beta_{cf}$, width $L_1=2L/3$. The inside part $S_{42}$ is covered by backward teeth. Calculation formula for angle $\alpha_H$ optimum value is $\alpha_H=(\beta_{ic'}-H)/2$, wherein $H=\beta_{ca'}$, width $L_2=L/3$, so that the reflected light cannot reach the underside of the adjacent upper slat, and the included angle between the guided light and the horizontal plane is larger than 50° when solar elevation angle is $\beta_{cf}\leq H\leq\beta_{cb'}$.

FIG. 25*a*-FIG. 25*d* shows schematic diagrams of two symmetrical V-shaped slats combination blind ($\gamma_1=-18°$, $\gamma_2=18°$) with advertising bracket ($\gamma_1=-55°$, $\gamma_2=18°$) retro-reflects and guides sunlight according to different solar elevation angle H in summer and winter. Referring to the figure, blind retro-reflects sunlight back to the outdoor space to avoid overheating and glare in summer, and guides sunlight into deep room to illuminate whole room so as to get uniform luminance in winter. When solar elevation angle is $H\leq\beta_{cb'}$, the sun-shading component is spread to block part of sunlight that can cause glare, meanwhile, part of sunlight is guided into the indoor space for lighting.

Said embodiment is optimized one not only one of recent invention. For technician in this field, some improvements or modifies basing the principle of this invention should be under the protection range of this invention.

What is claimed is:

1. A blade for a multi-slat combination blind of rotating type comprising:

a main slat (1) and at least one rotating slat (2);

the main slat (1) is composed of an outside part and an inside part, the outside part and inside part each have a free distal end and an inner end, a joint section is formed on the main slat where the inner ends of both the outside part and inside part meet, a first included angle between the outside part of the main slat (1) and a horizontal plane is $\gamma_1$ a second included angle between the inside part and the horizontal plane is $\gamma_2$;

the at least one rotating slat (2) is hinged on the main slat (1) at a location spaced from the distal ends of both the outside part and inside part;

wherein at least one of the included angles $\gamma_1$ and $\gamma_2$ is greater than 0 degrees.

2. The blade for a multi-slat combination blind of rotating type according to claim 1, wherein said least one rotating slat comprises two rotating slats (2, 3), which are hinged on the main slat (1).

3. The blade for a multi-slat combination blind of rotating type according to claim 1, wherein said outside part of the main slat (1) has a plane cross section, the inside part of the main slat (1) has an arc-shaped cross section.

4. The blade for a multi-slat combination blind blind of rotating type according to claim 1, wherein a sun shading slat (4) is set under the main slat (1) and is able to furl to an underside of the main slat.

5. The blade for a multi-slat combination blind blind of rotating type according to claim 1, wherein a V-shaped advertising bracket (7) is fixed on an underside of the main slat (1), a sun-shading slat (4) is hinged on a bottom (b') of the V-shaped advertising bracket.

6. The blade for a multi-slat combination blind blind of rotating type according to claim 1, wherein a surface (21) and back surface (22) of the rotating slat have micro-teeth.

7. The blade for a multi-slat combination blind of rotating type according to claim 1, wherein said main slat (1) has an asymmetrical V-shaped cross section.

8. The blade for a multi-slat combination blind of rotating type according to claim 7, wherein an included angle between the outside part of the main slat (1) a and the inside part of the main slat (1) is from 110° to 250°.

9. The blade for a multi-slat combination blind of rotating type according to claim 1, wherein said main slat (1) has a symmetrical V-shaped cross section, the joint section is a bottom edge (b'), which is a hinge axis for the rotating slat (2).

10. The blade for a multi-slat combination blind of rotating type according to claim 9, wherein the outside part and the inside part of the main slat (1) have an arc-shaped cross section.

11. The blade for a multi-slat combination blind of rotating type according to claim 9, wherein an included angle between the outside part of the main slat (1) and the inside part of the main slat (1) is from 110° to 250°.

12. The blade for a multi-slat combination blind blind of rotating type according to claim 1, wherein an upper side of the main slat (1) has micro-teeth.

13. The blade for a multi-slat combination blind blind of rotating type according to claim 12, wherein said micro-teeth are retro-reflection teeth.

14. The blade for a multi-slat combination blind blind of rotating type according to claim 12, wherein said micro-teeth are forward or backward teeth.

* * * * *